US005637964A

United States Patent [19]

Hakkarainen et al.

[11] Patent Number: 5,637,964

[45] Date of Patent: Jun. 10, 1997

[54] REMOTE CONTROL SYSTEM FOR INDIVIDUAL CONTROL OF SPACED LIGHTING FIXTURES

[75] Inventors: Simo P. Hakkarainen, Bethlehem; Russell L. MacAdam, Allentown; Scott C. Miller, Lehighton; Ian Rowbottom, Chalfont; Joel S. Spira, Coopersburg, all of Pa.

[73] Assignee: Lutron Electronics Co., Inc., Coopersburg, Pa.

[21] Appl. No.: 407,696

[22] Filed: Mar. 21, 1995

[51] Int. Cl.[6] ..... G05F 1/00

[52] U.S. Cl. ..... 315/295; 315/321; 315/149; 315/158; 315/DIG. 4

[58] Field of Search ..... 315/295, 294, 315/250, 312, 314, 318, 321, 362, DIG. 4, 149, 158; 340/567, 693; 362/20, 802

[56] References Cited

U.S. PATENT DOCUMENTS

| | | | |
|---|---|---|---|
| Re. 29,172 | 4/1977 | Lutz | 361/3 |
| 2,675,505 | 4/1954 | Flurscheim et al. | 317/11 |
| 2,748,226 | 5/1956 | MacNeill et al. | 200/148 |
| 3,223,888 | 12/1965 | Koppelmann | 317/11 |
| 3,237,030 | 2/1966 | Coburn | 307/130 |
| 3,249,810 | 5/1966 | Strom et al. | 317/11 |
| 3,284,648 | 11/1966 | Koppelmann | 307/136 |
| 3,321,668 | 5/1967 | Baker | 317/11 |
| 3,395,316 | 7/1968 | Denes et al. | 317/11 |
| 3,402,324 | 9/1968 | Kesseling et al. | 317/11 |
| 3,491,315 | 1/1970 | Kesseling et al. | 335/19 |
| 3,558,910 | 1/1971 | Dale | 307/134 |
| 3,636,292 | 1/1972 | Roth | 200/144 B |
| 3,639,808 | 2/1972 | Ritzow | 317/11 E |
| 3,864,604 | 2/1975 | Pfanzelt | 317/11 A |
| 3,868,549 | 2/1975 | Schaefer et al. | 317/11 E |
| 3,982,137 | 9/1976 | Penrod | 307/136 |
| 4,074,333 | 2/1978 | Murakami et al. | 361/13 |
| 4,152,634 | 5/1979 | Penrod | 318/739 |
| 4,209,814 | 6/1980 | Garzon | 361/5 |
| 4,236,101 | 11/1980 | Luchaco | 315/158 |
| 4,251,845 | 2/1981 | Hancock | 361/8 |
| 4,346,419 | 8/1982 | Janniello | 361/2 |
| 4,349,748 | 9/1982 | Goldstein et al. | 307/132 E |
| 4,389,691 | 6/1983 | Hancock | 361/8 |
| 4,392,171 | 7/1983 | Kornrumpf | 361/5 |
| 4,709,188 | 11/1987 | Roberts | 315/178 |
| 4,727,296 | 2/1988 | Zaharchuk et al. | 315/295 |
| 4,772,809 | 9/1988 | Koga et al. | 307/140 |
| 4,855,612 | 8/1989 | Koga et al. | 307/140 |
| 4,889,999 | 12/1989 | Rowen | 315/295 X |
| 5,107,184 | 4/1992 | Hu et al. | 315/291 |
| 5,191,265 | 3/1993 | D'Aleo et al. | 315/295 |
| 5,283,706 | 2/1994 | Lillemo et al. | 361/3 |
| 5,404,080 | 4/1995 | Ouazi | 315/151 |
| 5,451,843 | 9/1995 | Kahn et al. | 315/186 |
| 5,489,891 | 2/1996 | Diong et al. | 315/159 X |

FOREIGN PATENT DOCUMENTS

| | | |
|---|---|---|
| 0062004 | 10/1982 | European Pat. Off. . |
| 0482680 | 4/1992 | European Pat. Off. . |
| 4124794 | 1/1993 | Germany . |

OTHER PUBLICATIONS

Co–Pending Patent Application No. 08/585,111.

*Primary Examiner*—Robert Pascal
*Assistant Examiner*—Haissa Philogene
*Attorney, Agent, or Firm*—Ostrolenk, Faber, Gerb & Soffen, LLP

[57] ABSTRACT

A plurality of spaced ceiling mounted fixtures or other controllable electrical appliances have wide angle radiation detectors mounted within each fixture and wired internally of the fixture to a dimming circuit or to a ballast. The radiation detectors have sensitivity over a wide angle and are fixed over a small opening in the fixture. A narrow beam radiation transmitter selectively illuminates one of the radiation detectors without illuminating the others. The dimming circuits or ballasts within the fixtures can be further controlled by external dimmers, occupancy sensors, timeclocks, photosensors and other types of input devices.

72 Claims, 18 Drawing Sheets

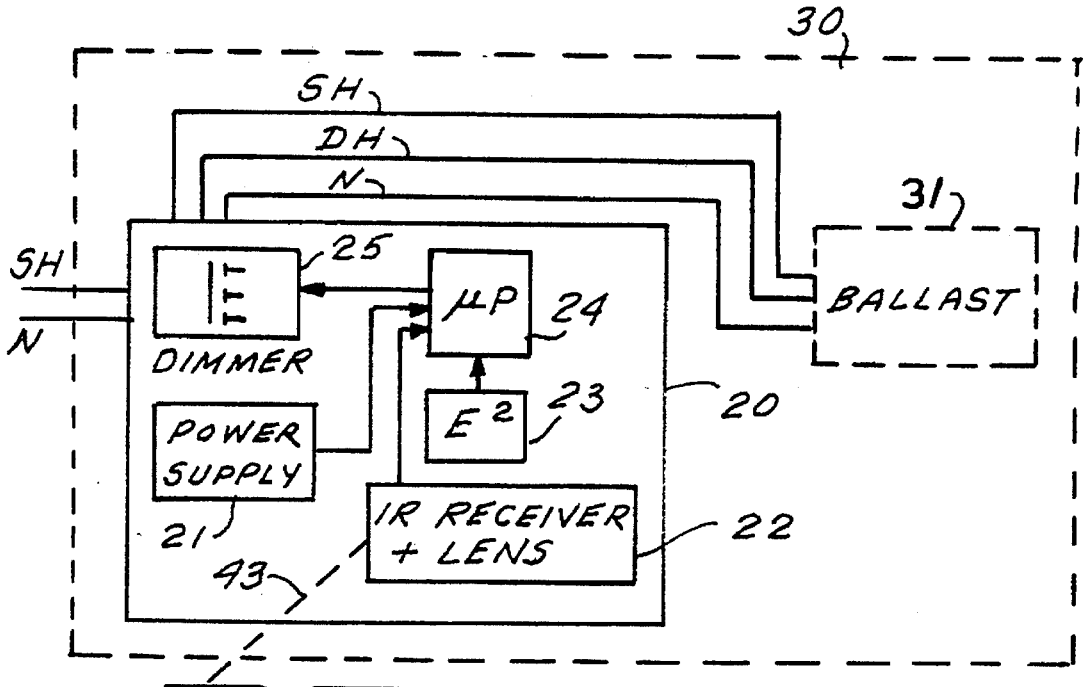
FIG 1
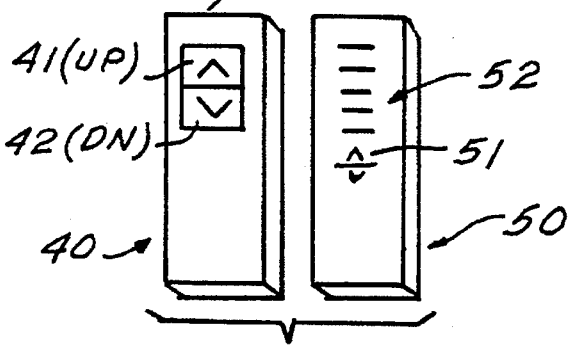
FIG. 14
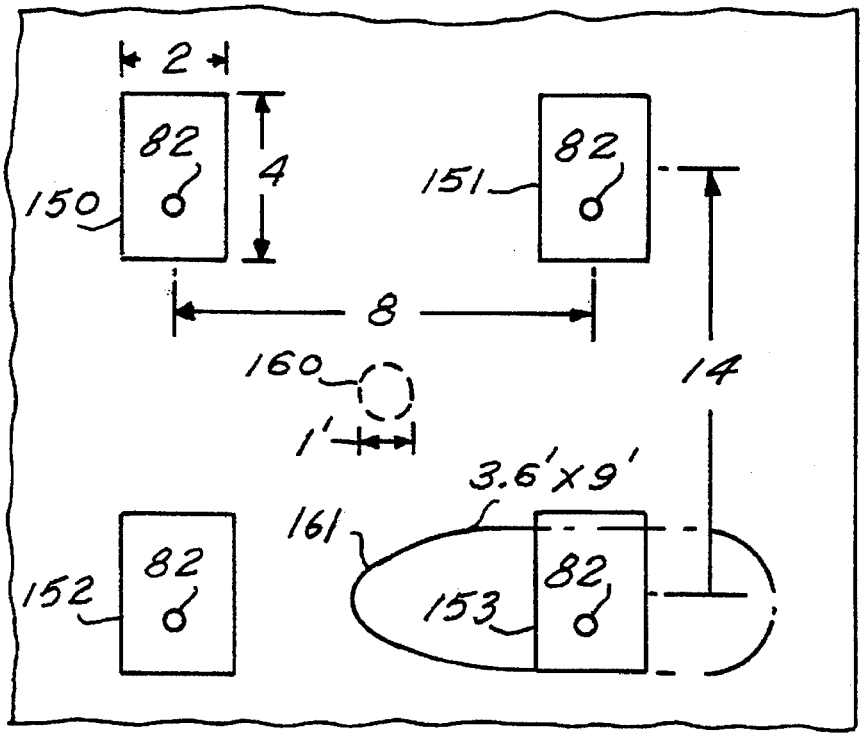

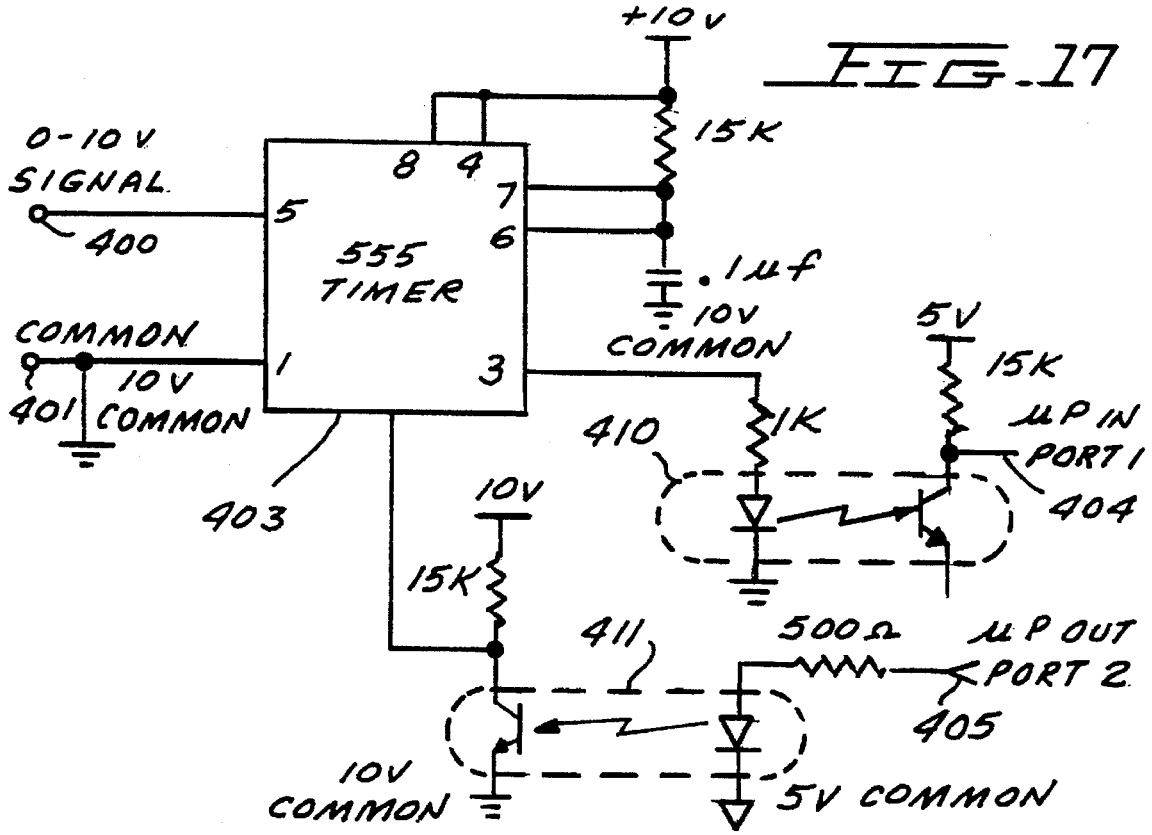
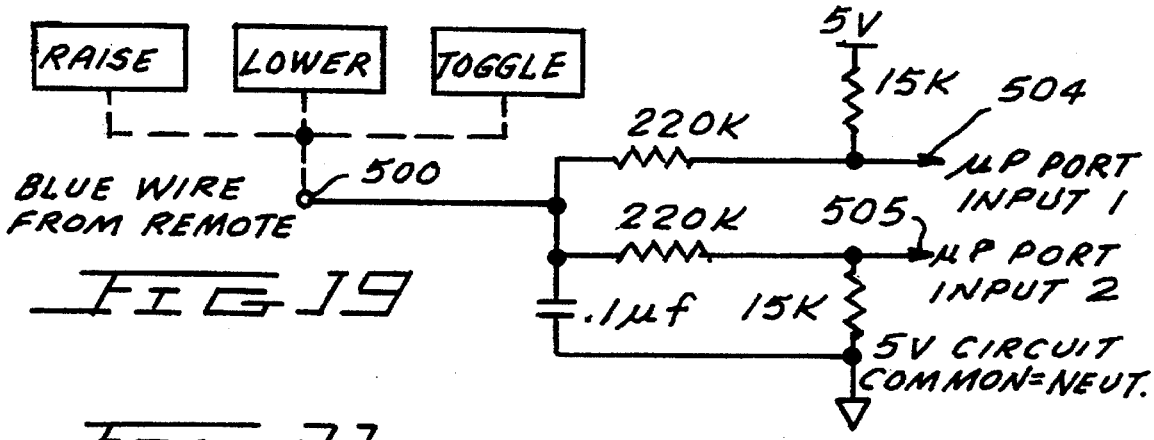
FIG 19
FIG 21
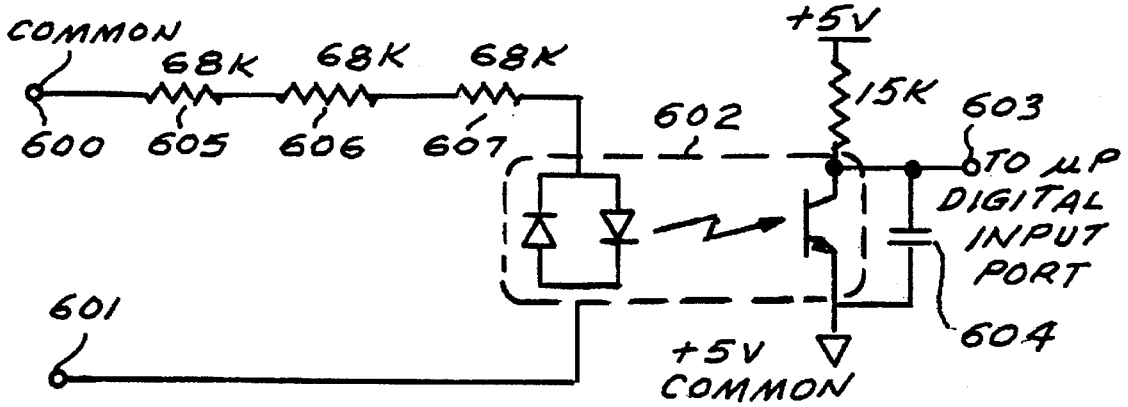

REMOTE CONTROL SYSTEM FOR INDIVIDUAL CONTROL OF SPACED LIGHTING FIXTURES

FIELD OF THE INVENTION

This invention relates to the remote control of lighting fixtures, and more particularly relates to a system for the selective control of overhead lighting fixtures by a hand-held infrared radiation source.

BACKGROUND OF THE INVENTION

The lighting of spaces by a plurality of spaced gas discharge lamps (for example, fluorescent lamps), or incandescent lamps is well known. Commonly, one or more fluorescent lamps are mounted in a fixture with a ballast, and such fixtures are spaced over a ceiling on four foot or eight foot centers. Similarly, overhead fixtures for incandescent lamps may be mounted on centers greater than about two feet. Such lamp fixtures are commonly connected to a single power source and are simultaneously turned on and off or, if provided with dimming capability, are simultaneously dimmed.

It is also known that such overhead fixtures can be individually controlled or dimmed. For example, in a given office space, one worker may prefer or need more or less light intensity than another worker at a spaced work area. Dimming systems are known for selectively dimming the lamps of different fixtures to suit the needs of individual workers. For example, each fixture can be individually hard wired to its own remotely mounted dimmer. However, the installation of this wiring can be quite costly and the determination of which dimmer controls which fixture may not be immediately obvious to the user of the system.

Alternatively the dimmers could be located within each fixture and controlled by signals sent over low voltage wiring or through signals transmitted over the line voltage wiring through a power line carrier system. Unfortunately, both of these approaches require expensive interfaces within each fixture to translate and/or decode the received signals for control of the dimmer.

In another known system, a dimmer with a dimming adjustment control is provided at each fixture, and that control is manually operated, for example by rotating the control with a rigid pole long enough to reach the fixture. In this way, each fixture can be selectively adjusted. However, the system is inconvenient to use and, once the fixture intensity is set, it is difficult or inconvenient to readjust. Moreover, it is difficult to retrofit an existing installation with a control system of this nature.

A known fluorescent controller system is also sold by Colortran Inc. of Burbank, Calif., termed a "sector fluorescent controller" in which an infrared receiver is mounted at a location spaced from its respective fluorescent lamp fixture. Thus, the receiver is fixed to a T-bar, on the wall, on a louver or is counter-sunk flush with wall or ceiling. A ballast controller may be mounted in the lighting fixture, in addition to a conventional dimming ballast. Wiring is then run from the external infrared receiver into the interior of the fixture to the ballast controller. A hand-held remote control infrared transmitter illuminates the infrared receiver at one or more fixtures to control their dimming level.

The need to run wiring from the external sensor complicates the installation of such devices. Further, since the sensor is spaced from the fixture, it requires separate installation, and is visible to view. Moreover, the infrared transmitter of the Colortran device has a transmitting angle of 30°. Therefore, several receivers can be illuminated simultaneously, making selection of control of only one fixture difficult unless the user places himself in a precise location within the room under the fixture to be controlled.

A similar system is sold by the Silvertown Hitech Corporation, where the infrared receiver is mounted to the louvers of a fluorescent fixture. In this system, the infrared receiver is specifically adapted to be mounted to a specific fluorescent fixture.

A further system is sold by Matsushita wherein a single transmitter can be used for independent control of two or more different receivers. This is achieved by adjusting a switch on the transmitter to correspond to a switch setting which has been previously set at the receiver corresponding to the fixture desired to be controlled. For example, fixture A could be controlled when the switch is in position 1 and fixture B could be controlled when the switch is in position 2. In this system, the user must remember which fixture corresponds to which switch position, i.e., A corresponds to 1 and B corresponds to 2.

It is easy for the user to forget and become confused, particularly when there are three or four fixtures controlled by three or four switch positions. This is an undesirable situation. Further, there is a practical limitation on the number of switch positions which can be provided and the number of fixtures in a large room will exceed this. Additionally, there is a great deal of work in programming and reprogramming the receivers for a large number, for example, 20 fixtures.

In comparison, as will be described in more detail later, with the system of the invention, the transmitter is simply pointed at the receiver in the fixture which it is desired to control. This is simple, unambiguous and transparently ergonomic. Further, it does not require any preprogramming or reprogramming of the receivers.

It is also known to use an infrared transmitter for the control of a wall box mounted dimmer, such as the "Grafik Eye" Preset Dimming Control sold by Lutron Electronics Co., Inc., the assignee of the present invention. Also see U.S. Pat. No. 5,191,265 which describes such transmitters. The Grafik Eye Dimmer Control system provides remote control of fixtures and other lamps by a control circuit located at the wall box which controls those fixtures and lamps. An infrared transmitter aimed at the wall box housing produces a beam which contains information to turn on and off and to set the light dimming level of the fixtures being controlled to one of a plurality of preset levels, or to continuously increase or decrease the light level. Other similar systems are sold by Lutron Electronics Co., Inc. under the trademark RanaX-Wireless Dimming Control System. Such systems are not intended to control individual ceiling fixtures in a room independently of other closely spaced fixtures (those fixtures spaced up to about two feet apart).

BRIEF SUMMARY OF THE INVENTION

In accordance with the present invention, each fixture to be controlled has a radiation receiver and ballast control circuit mounted in the interior of the fixture housing and is wired internally of the fixture housing to a dimming ballast in the case of a fluorescent fixture. In the case of an incandescent fixture, each light to be controlled has a radiation receiver and dimmer, which is connected to the lamp to be controlled. A small opening in the fixture housing allows optical communication with the radiation receiver and is easily illuminated from substantially any location in the room containing the fixtures. A narrow beam radiation transmitter with a beam angle, for example, of about 8° is employed to illuminate the radiation-receiving opening in the fixture without illuminating the fixtures spaced greater than about two feet from the fixture to be controlled. For rooms about thirty feet by thirty feet in area and ten feet high, fixtures two feet apart can be easily discriminated between one another. For larger spaces, the user can reposition himself to discriminate between closely spaced fixtures.

The receiver is a novel structure consisting of a printed circuit board mounted across a central area of a typical back box. A radiation sensor is mounted on the printed circuit board and faces an open side of the box which is covered by a yoke. The radiation employed is preferably infrared light and the yoke has an optically transparent portion to allow infrared radiation to reach the radiation sensor. Narrowly focused, high frequency ultrasound could also be employed.

In addition, either a visible or invisible laser beam with information encoded on it in known manner could be used, with the laser beam being spread by optical means such as a divergent lens. In the case of a visible beam, this would produce a beam like a flashlight which would aid in pointing the transmitter at the receiver.

Finally, narrowly focused radio frequency waves could be used. These could be emitted from a parabolic reflector on the transmitter with a parabolic reflector of approximately 4.3 cm in diameter and a frequency of 60 GHz the beam spread would be approximately 8°. (50 GHz=0.6 cm wavelength $\lambda$). The angle ($\theta$) in radians of a beam leaving a parabola of diameter d is given by $\theta=\lambda/d$).

To install the receiver structure, a novel mounting structure is provided whereby a plastic hook and loop type fastener surface is fixed to the yoke and a cooperating hook and loop type surface is attached to the interior of the fixture, preferably on the wire way cover within the fixture. All wires can then be interconnected within the fixture wire-way. An opening is formed in the wire-way cover of the fixture and optically communicates with the radiation receiver within the receiver housing. The receiver housing is easily located within the housing to communicate with the opening in the wire-way cover and is then pressed in place. An optical lens insert can be installed in the yoke to assist in focusing input radiation on the radiation receiver sensing element. This lens insert can be interchangeable and different lens inserts can be designed to have different angles of acceptance of input radiation. The angle of acceptance of input radiation can be further adjusted by varying the distance from the yoke to the radiation sensor.

The lens protrudes slightly through an opening in the fixture housing to receive infrared radiation from the transmitter. The transmitter is preferably an infrared transmitter of the type employed in the Lutron Grafik Eye system transmitter previously identified for use with wall box dimmer systems. The Grafik Eye transmitter is an infrared transmitter which transmits signals with twelve different code combinations. The transmitter is operable to transmit a beam angle of about 8° and can, therefore, selectively illuminate relatively closely spaced ceiling fixtures. Depending on the control which is activated, a selected fixture can be dimmed to one of a plurality of preset dim conditions, or can be dimmed continuously up or down. Thus, the transmitter can accomplish raise/lower, presets, low/high end trim and the like. Alternatively, a transmitter with a movable slide or rotary actuator could be used to provide continuous dimming control.

The present invention has a major advantage in retrofitting an existing installation. Thus, it is only necessary to drill a small opening in the wire-way cover, mount an infrared receiver/ballast controller to the wire-way cover in line with the opening within the wire-way cover. Light dimming ballasts are then mounted within the fixture wire-way and are interconnected with the receiver/ballast controller within the fixture wire-way without need for external wiring. The wire-way cover with receiver/ballast controller attached is then reinstalled in the fixture.

The present invention can be used with a large variety of existing fixtures and can also be used with external switches and dimming circuits. Photocells, occupancy sensors, time clocks, central relay panels and other inputs can also be used with the novel system. Furthermore, the present invention makes it possible for a single receiver to operate any desired number of ballasts.

The invention's primary application is in large open plan office areas illuminated by overhead fluorescent fixtures, particularly where video display units (e.g., personal computers) are used. However, the invention also has applications in areas which are used for audio visual presentations, in hospitals and elder care facilities, in manufacturing areas and in control rooms.

The invention can be used to control security lighting either indoor or outdoor and to reduce lighting levels for energy conservation.

A further application of the invention is in wet or damp locations where normal wall controls cannot be used due to the danger of electric shock or in areas with hazardous atmospheres where there is a danger of explosion if a line voltage wall control is operated and causes a spark. In these cases, the receiver of the invention can be located in a protected fixture and the lights controlled by the low voltage hand-held remote control transmitter.

The invention has been described with respect to the control of light levels. However, the output from the receiver could be adapted in known manner to control motor speed and/or position such as the position of the motors in window shade control systems. The output from the receiver could further be adapted to control other types of actuators such as solenoids.

Other features and advantages of the present invention will become apparent from the following description of the invention which refers to the accompanying drawings.

BRIEF DESCRIPTION OF THE DRAWINGS

FIG. 1 is a block diagram of the lighting fixture adapted with a radiation receiver/ballast control circuit in accordance with the invention and with remote radiation transmitters.

FIG. 14 is a diagram showing four spaced fixtures on a ceiling with the outline or "footprint" of the radiation from a transmitter with an 8° beam at two different locations in the room containing the fixtures.

FIG. 17 is a circuit diagram of an external dimmer input to the dimming ballast of FIG. 13, along with the remote transmitter input in which the external control signal varies from 0 to 10 volts.

FIG. 19 is a circuit diagram of an external dimmer which produces "raise" and "lower" signals which can be applied to the system of FIG. 15.

FIG. 21 shows a circuit diagram of an external dimmer which produces a phase delayed control circuit which cam be applied to the system of FIG. 15.

DETAILED DESCRIPTION OF THE DRAWINGS

Figure 2:
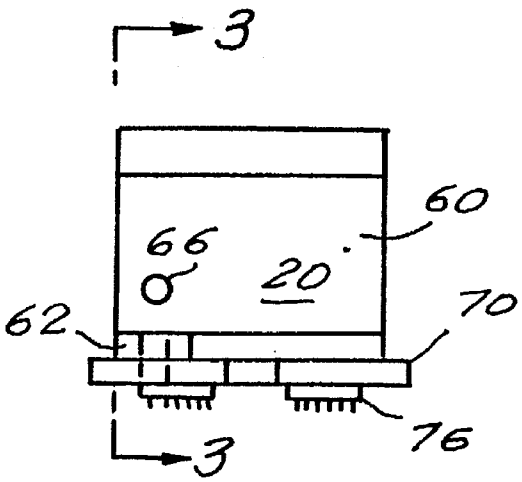
FIG. 2 is an elevational view of the receiver/ballast control circuit housing of the present invention.

Referring first to FIG. 1, there is shown a block diagram of the novel system of the invention in which a single radiation receiver/ballast control circuit 20 contains a circuit consisting of a power supply 21, an infrared signal receiver 22, an EEPROM circuit 23, a microprocessor 24 and a dimmer circuit 25 which includes an appropriate semiconductor power switching device.

While receiver 22 could respond to any desired narrow band radiation, it is preferably a receiver of radiation in the infrared band.

Radiation receiver/ballast control circuit 20 is mounted within a lighting fixture 30 as will be later described in more detail. Fixture 30 also contains a dimming ballast 31 of known variety which can energize one or more gas discharge lamps, such as 32-watt fluorescent lamps, in a controlled manner. Ballast 31 may be a dimming ballast known as the "Hi-Lume" ballast or the "ECO-10" ballast, each sold by Lutron Electronics Co., Inc., the assignee of the present invention.

Ballast 31 typically has three input leads taken from radiation receiver/ballast control circuit 20, including lead SH (switched hot), lead DH (dim hot) and N (neutral). Input leads SH (switched hot) and N (neutral) are connected to receiver/ballast control circuit 20. Significantly, since receiver/ballast control circuit 20 and ballast 31 are both within fixture 30, all wiring interconnections between the two are also within the fixture.

In order to control the dim level of the fixture of FIG. 1, an infrared transmitter of known variety is employed. Thus, two kinds of transmitters are shown in FIG. 1. The first is transmitter 40 which is a known type of raise/lower transmitter. Transmitter 40 is a small hand-held unit which has an "up" control button 41 and a down control button 42. Pressing either of these buttons 41 or 42 will cause the generation of a narrowly focused coded beam of infrared radiation 43 (with an 8° beam angle) which can illuminate the photosensor in receiver 22 to cause the lamps controlled by ballast to increase or decrease, respectively, their output light.

As will be later seen, a plurality of fixtures 30 in a single room can be individually controlled by a single transmitter 40 from almost any location in most rooms.

A more elaborate transmitter 50 may be used in place of transmitter 40. Thus, transmitter 50 is of the type sold by Lutron for the remote control of wall mounted dimmer controls sold under the trademark, Grafik Eye. The transmitter 50 has an up/down control 51 and a plurality of push buttons 52 which correspond to, and place the ballast 31 in one of a plurality of preset dimmer conditions. Its operation is described in U.S. Pat. No. 5,191,265.

As will later be described, either of the transmitters 40 or 50 may also be used to calibrate the dim settings of the lamps being controlled in the manner described in U.S. Pat. No. 5,191,265. When using the transmitter 50, low end calibration and other parameter calibrations can be accomplished by pressing combinations of preset buttons 52 to send out appropriately coded signals.

Figure 4:
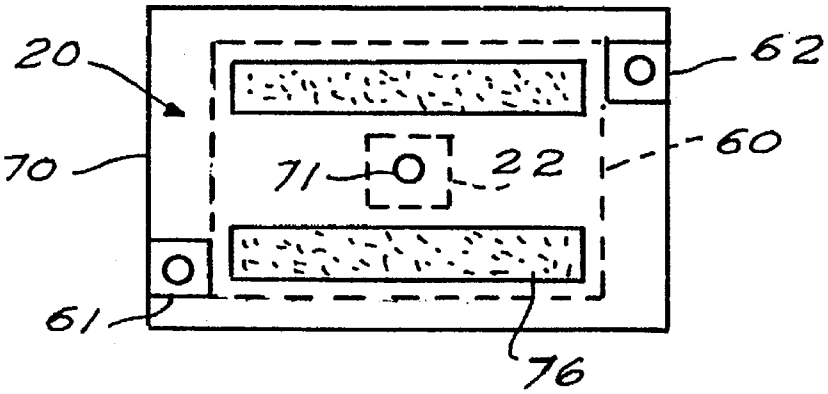
FIG. 4 is a bottom view of the receiver/ballast control circuit housing of FIGS. 2 and 3.
Figure 3:
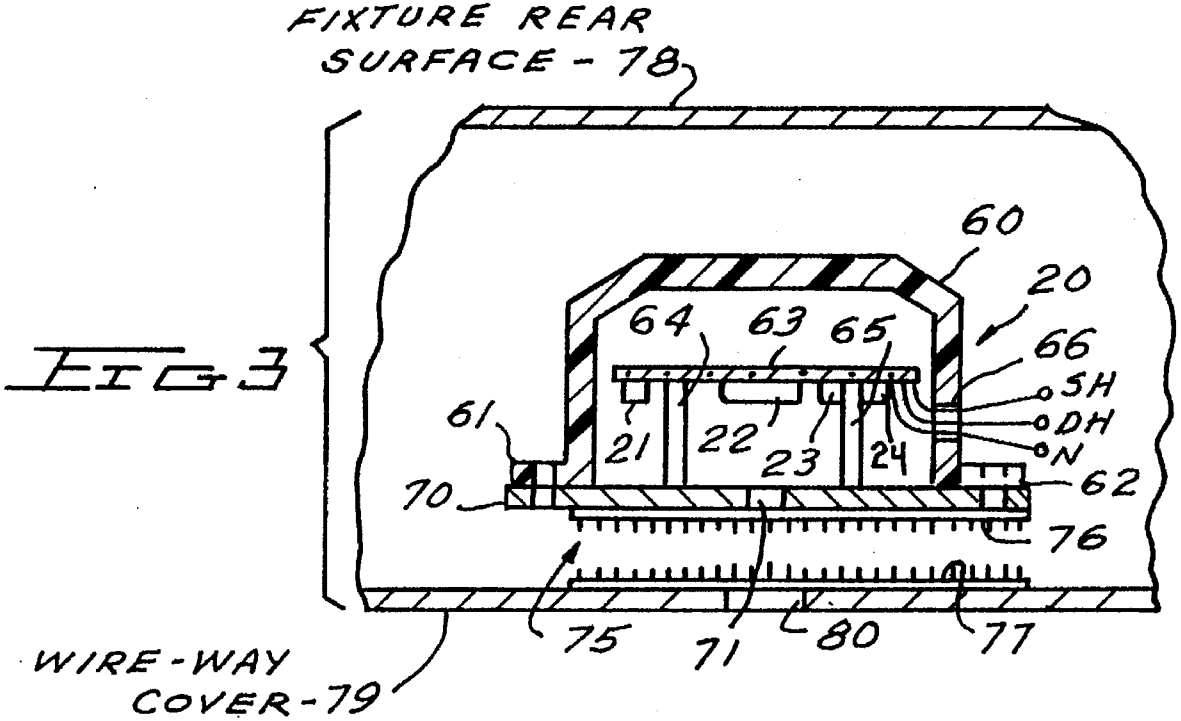
FIG. 3 is in part, a cross-section of FIG. 2 taken along the section line 3—3 in FIG. 2 and also shows the plastic yoke, fixture rear surface and wire-way cover, and a hook and loop type fastener in exploded view.

The structure of radiation receiver/ballast control circuit 20 of FIG. 1 is shown in FIGS. 2, 3 and 4. Referring to these figures, the radiation receiver/ballast control circuit 20 is housed in a conventional plastic back box 60 which has projecting mounting ears 61 and 62. A circuit board 63 is mounted to yoke plate 70 on conventional snap-in posts 64 and 65 (FIG. 3). Circuit board 63 carries infrared sensor 22, and also carries integrated circuits including the power supply 21, microprocessor 24 and EEPROM 23 and, in some cases, a power semiconductor 25 (not shown in FIG. 3). Leads SH, DH and N extend through an opening 66 in the housing 60.

The side of housing 60 is ordinarily closed by a metal yoke. In accordance with the present invention, the yoke plate 70 is formed of plastic and has a hole 71 cut in it which is transparent to the infrared or other radiation which is used. Thus, as shown in FIG. 4, the sensor 22 can be illuminated through plate 70.

In order to mount the housing 60 within a lighting fixture, a novel hook and loop tape (sold under the trademark Velcro) mounting system is used. Thus, Velcro tape, supplied in reel form, has two cooperating tapes releasably fastened together with a pressure-sensitive adhesive on their outer surfaces. The adhesive surfaces are covered by release strips. Two lengths 75 of such tape are cut to fit over portions of yoke 70 as shown best in FIG. 4. The release strips are removed from upper Velcro strips 76 and the Velcro strips are adhered to the bottom of yoke 70. When the housing 60 is to be mounted, the release strip on the bottoms of tape strips 77 are removed (FIG. 3). The housing 60 is then positioned so that the light sensor 22 is disposed above the radiation receiving opening 80 (FIG. 3) in wire-way cover 79. The lower strip is then pressed into contact with the rear interior surface of the lighting fixture wire-way cover 79 (FIG. 3).

Figure 5:
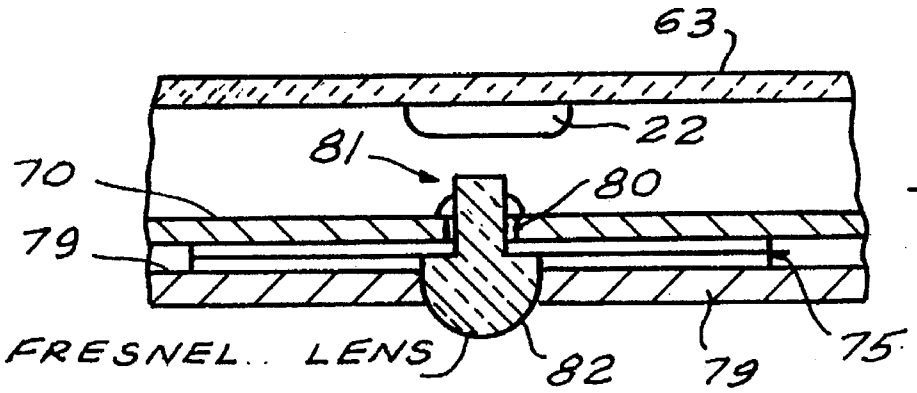
FIG. 5 shows a cross-sectional view of the wire-way cover with a snap-in wide-angle infrared transparent lens in place in the receiver/ballast control circuit housing.

Preferably, and as shown in FIG. 5, a snap-in infrared lens 81 is snapped into opening 71. Lens 81 can be designed to have any desired angle of acceptance of incident radiation, and hence different lenses may be used to suit the requirements of a particular application. Thus, lens 81 has a fresnel lens 82 on its outer surface so that infrared radiation coming toward lens 81 from even very shallow angles to the ceiling surface will be refracted along its axis and toward sensor 22, through hole 71 in yoke 70.

While the drawings show the lens 81 lined up directly with sensor 22, it is possible to employ a light conducting fiber to convey sensed radiation to the sensor 22, which may then be laterally removed from lens 81.

Lens 81 can be designed to have any desired angle of acceptance for incident radiation and hence different lenses may be used to suit the requirements at a particular application.

Figure 6:
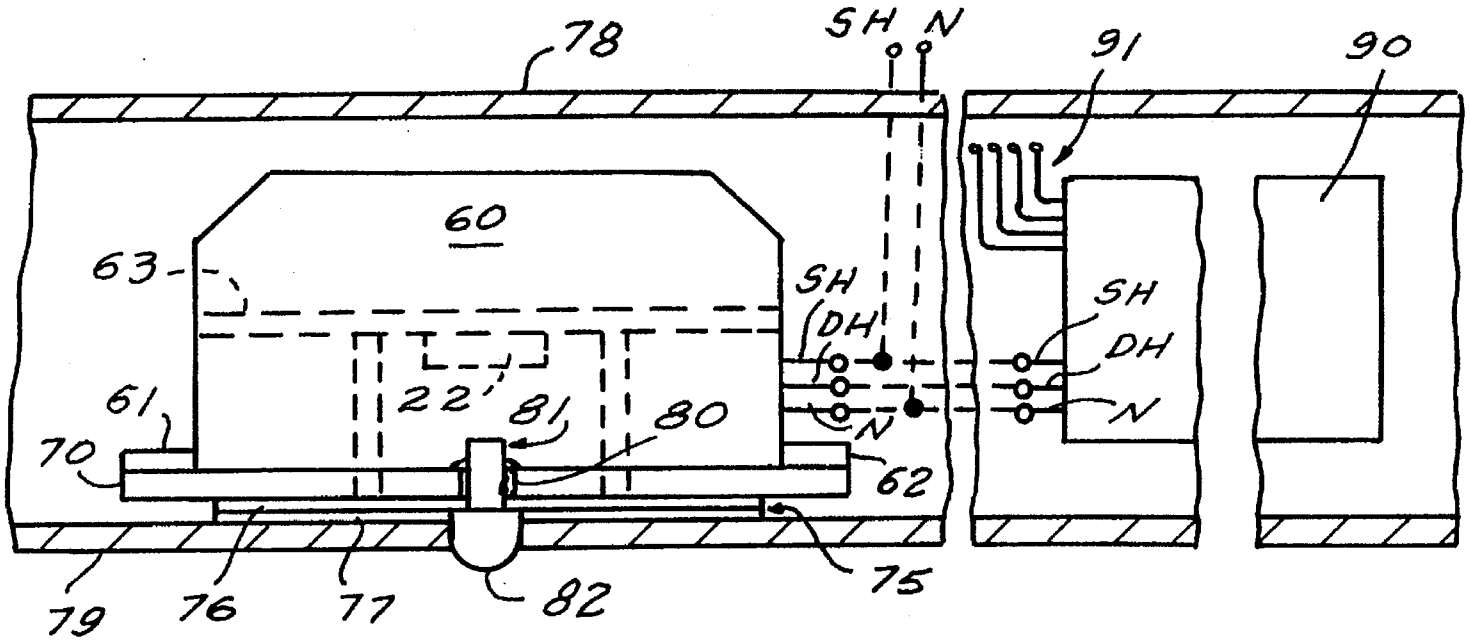
FIG. 6 is a partial cross-sectional view showing the receiver/ballast control circuit of FIG. 3 with the lens of FIG. 5 located within the wire-way of the fixture, and connected internally of the fixture to the dimming ballast leads.

FIG. 6 shows receiver housing 60 fixed in position between the fixture rear surface 78 and wire-way cover 79 as previously described. FIG. 6 also shows the dimming ballast 90 which is also fixed to fixture surface 78 in any suitable manner. Ballast 90, which may replace a non-dimming ballast in a retrofit installation, has three input leads SH, DH and N which are conveniently connected to corresponding leads from radiation receiver/ballast control circuit 20 within the fixture interior. Output ballast leads 91 are connected to the lamps.

Ballast 90 can be any desired dimmer ballast, for example, the Lutron® Hi-Lume® ballast.

During the retrofitting operation, the installer need only drill the small hole 80 in the wireway cover 79. The ballast 90 and radiation receiver/ballast control circuit 20 are then easily installed and wired together and the wire-way cover is reinstalled with lens 81 aligned to the position of hole 80 in wire-way cover 79. Thus, retrofitting is easily done in a short time.

Figure 8:
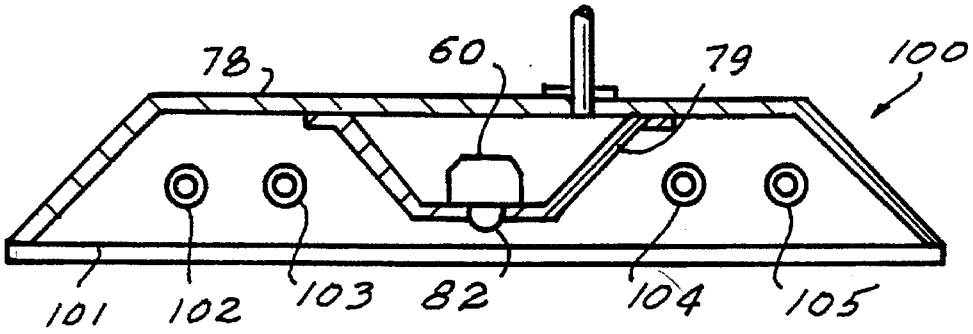
FIG. 8 is a cross-section of FIG. 7, taken across the section line 8—8 in FIG. 7.
Figure 7:
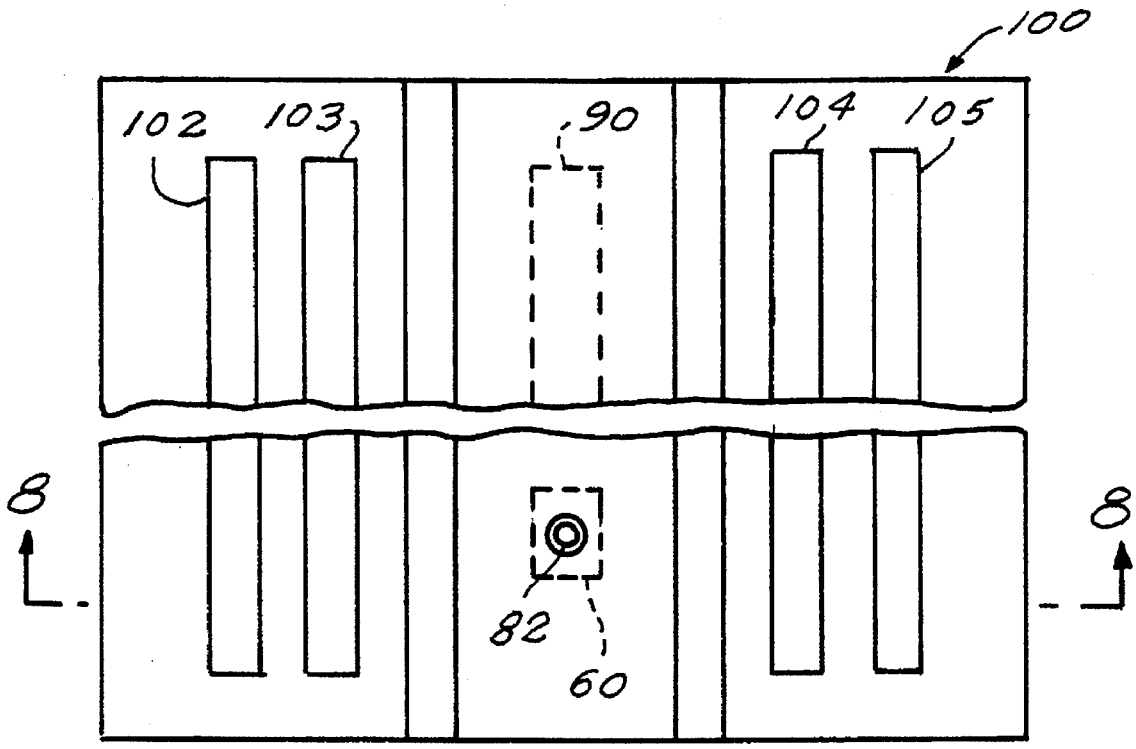
FIG. 7 is a view of the bottom or light output side of a fluorescent light fixture with prismatic lens which contains the novel infrared receiver of the invention.

FIGS. 7 and 8 show a conventional fluorescent light fixture 100 with a prismatic lens cover 101. A typical fixture of this type will be two feet wide and four feet long and will contain four 32-watt fluorescent bulbs 102, 103, 104 and 105. All wiring and the ballast 90 for the lamps is contained behind wire-way cover 79 which may be bolted or otherwise fastened to the fixture rear 78. Ballast 90 and radiation receiver/ballast control circuit 20 are contained within the fixture so that wiring connecting the two is not exterior of the fixture. Moreover, only the small lens protrusion 82 is visible outside the fixture.

Figure 9:
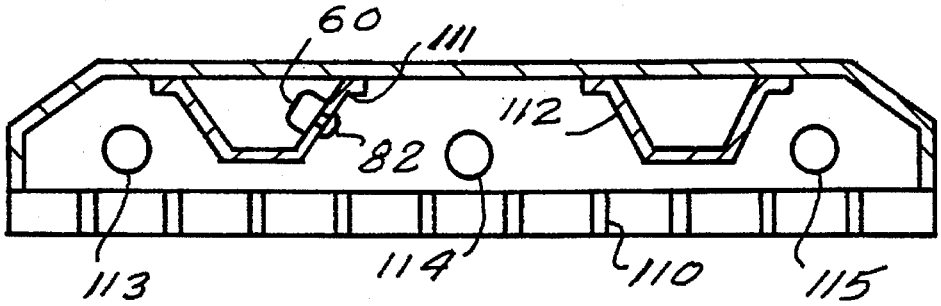
FIG. 9 is a cross-section of a fixture like that of FIG. 8 but with a louver instead of a prismatic lens.

The invention can be applied to many other types of fixtures. For example, FIG. 9 shows a fluorescent light fixture with a louver 110 in place of the prismatic lens 101 of FIG. 8. The fixture of FIG. 9 has two wire-way covers 111 and 112 for three lamps 113, 114 and 115. The ballast (not shown) and the radiation receiver/ballast control circuit 20 are mounted within cover 111 and a lens 81 with lens protrusion 82 projects into cover 111. The radiation receiver/ballast control circuit 20 is preferably mounted on one of the sloped sides of cover 111 if louvre 110 blocks the bottom of cover 111.

Figure 10:
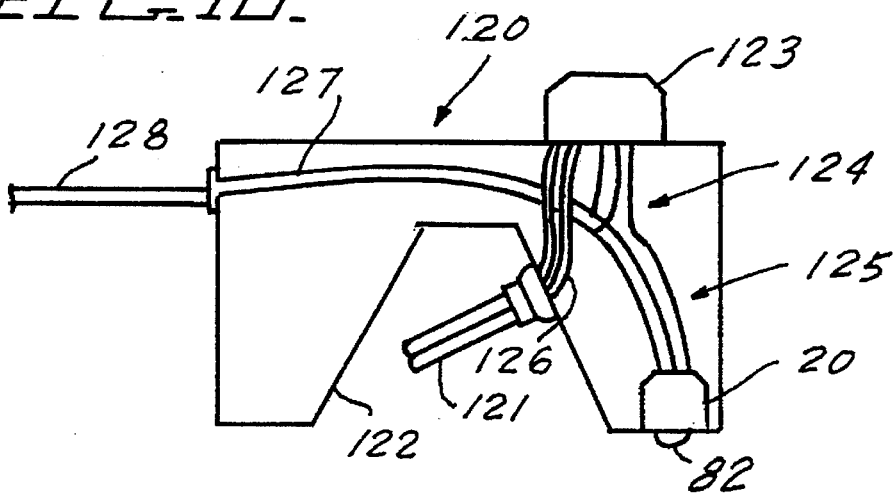
FIG. 10 is a schematic cross-section of a compact fluorescent down-light fixture equipped with the receiver/ballast control circuit of the invention.

FIG. 10 shows the manner in which the invention is applied to a compact fluorescent down-light fixture housing 120. Thus, a compact fluorescent lamp 121 is contained within reflector 122. A dimming ballast 123 is fixed to the exterior of housing 120 and its input wires 124 (SH, DH and N leads) are connected to related output wires 125 of radiation receiver/ballast control circuit 20. Radiation receiver/ballast control circuit 20 is mounted internally of fixture housing 120 as desired and lens 81 with lens protrusion 82 protrudes through an opening in housing 120 to be exposed to infrared signal illumination. The wiring connections between radiation receiver/ballast control circuit 20 and ballast 123 are made within the interior of housing 120. The output wiring 126 from ballast 123 to lamps 121 is also contained within the interior of housing 120. All input power lines (Switched Hot and Neutral) 127 come into housing 120 through wiring conduit 128. Thus, as in the prior embodiments, an unobtrusive infrared sensor is fixed to or retrofitted into an existing fixture 120 and all wiring connections are kept within the interior of housing 120.

Figure 11:
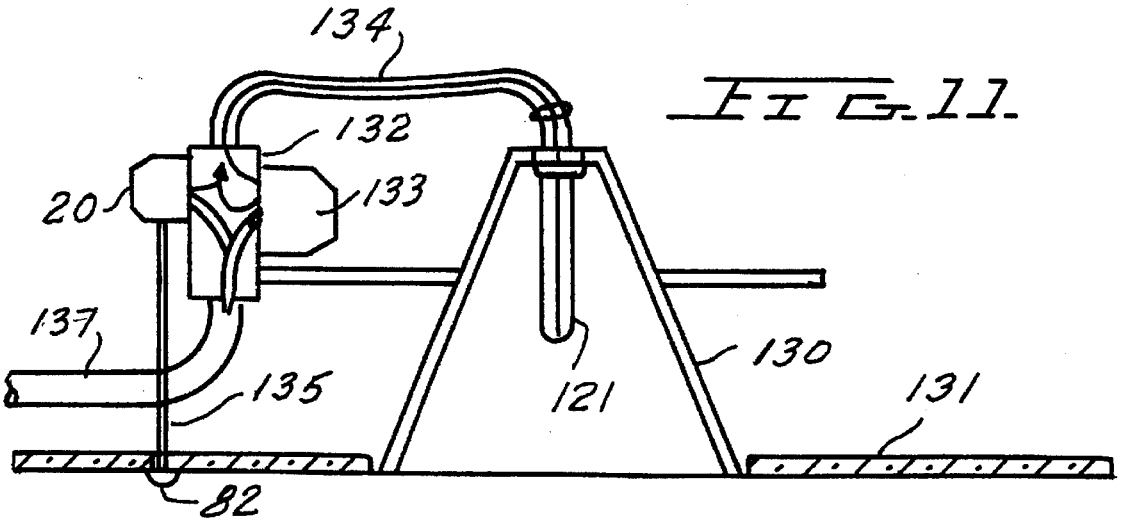
FIG. 11 is a schematic cross-section like that of FIG. 10 of a modified compact down-light fixture also containing the receiver/ballast control circuit of the invention.

FIG. 11 shows another type of fixture for compact fluorescent lamp 121. Thus, the housing 130 is a cone which is suitably mounted flush with a ceiling 131. A wiring box 132 is fixed to cone 130 and a dimming ballast 133 and radiation receiver/ballast control circuit 20 are mounted on opposite sides of box 132 and are interconnected within the box 132. Input power is brought into the fixture via metal conduit 137 and the output lines to lamp 121 are contained within conduit 134. Since this structure physically removes radiation receiver/ballast control circuit 20 from the area of ceiling 131, a light pipe 135 leads to lens 81 with lens protrusion 82 which is snap-mounted into the ceiling tile 131.

Figure 12:
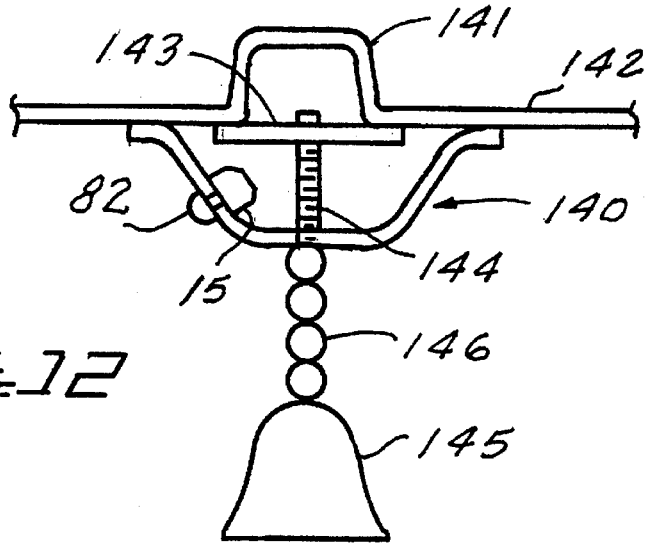
FIG. 12 schematically shows the application of the novel invention to an incandescent canopy fixture.

The present invention can also be applied to incandescent lamp ceiling fixtures, as shown in FIG. 12. Thus, in FIG. 12, an incandescent canopy fixture 140 includes a wiring box 141 fixed to ceiling 142. A support plate 143 extends across box 141 and receives a hollow threaded screw 144 which supports a lamp holder 145 from chain 146. In accordance with the invention, a radiation receiver/dimmer housing 15 having a lens 81 with protrusion 82 external of housing 140 is mounted within the housing. Power wiring from box 141 is connected to radiation receiver/dimmer 15 which contains a power semiconductor dimmer which is controlled by infrared signals received through lens 81. Output wiring from radiation receiver/dimmer 15, including the dim hot and neutral wires, extends through the center of screw 144 to the incandescent lamp or lamps in holder 145.

It will be apparent that incandescent lamp fixtures distributed over the surface of a ceiling can be adapted as shown and described in FIG. 12 to be selectively dimmed to suit individual users in different locations in the room. Moreover, such lamps can be mounted on centers greater than about two feet and still be discriminated from one another by an infrared transmitter having a beam dispersion of about 8°. It will also be apparent that the novel receiver of the invention can also be used on wall sconces and lamp cords and the like, as well as recessed incandescent down-lights similar in design to those of FIGS. 10 and 11 but designed for use with incandescent rather than fluorescent lamps.

Further, the invention can be applied to track lighting fixtures where the receiver/dimmer is built into an adaptor which mounts to the track and the fixture to be controlled is mounted to the adaptor.

A single receiver can control a plurality of ballasts which are in spaced fixtures. Fixtures equipped with the receiver of the invention can be used with added inputs, such as photocell detectors for adjusting lamp intensity in accordance with ambient light. Furthermore, the novel receiver can also be used with external dimming controls in which dimming of lamps can be accomplished under the control of an infrared transmitter, an occupancy detector, or a manual control or timer or the like.

Figure 13:
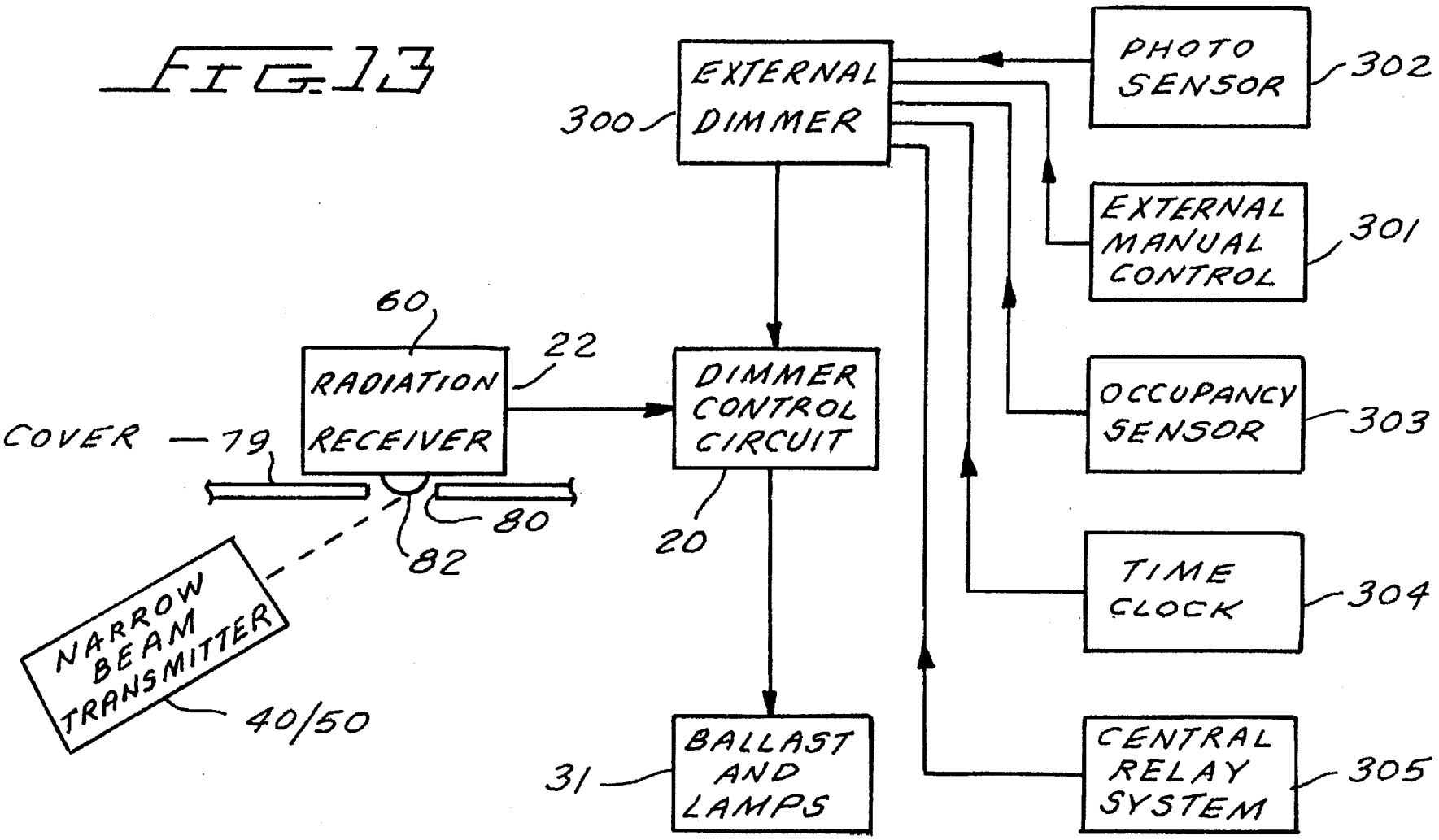
FIG. 13 is a block diagram of the present invention and shows the connection of auxiliary sensors and controls which allow dimming and on/off control functions.

FIG. 13 is a block diagram of the system of the invention having these various controls. Thus, in FIG. 13, radiation receiver housing 60 has face 82 of lens 81 exposed through an opening in cover 79. Radiation receiver housing 60 is suitably coupled to the dimmer control circuit 20 which controls the power which is applied to ballast 31 and the lamps driven by the ballast.

A number of inputs are shown for controlling the dimmer control circuit.

The first is the remote infrared transmitter 40 or 50 previously described.

The dimmer circuit 20 may also be controlled by external dimmer 300 which may be a conventional device arranged to control selective ones or groups of fixtures. Dimmer 300 may set the maximum light level of the lamp output or the minimum light level of the lamp output. It may also override the internal dimmer control circuit 20 to set the lamp output. In this case, the last operated of the external dimmer 300 or radiation transmitter 40/50 will determine lamp output.

The output signal of the external dimmer 300 can take many forms which are known in the prior art. For example, the signal can have the form of a phase controlled signal, a variable voltage signal or a raise/lower signal.

The output signal of the external dimmer 300 can be varied in response to numerous conditions. For example, it can be controlled manually, as by an external manual control 301 which can turn lamps on and off, and adjust their level or select from pre-set levels. Another input may consist of photosensor 302 which controls the dimmer output as a function of exterior ambient light. A conventional occupancy sensor 303, time clock 304, or central relay station control 305 can also be employed to override and turn the lamps on or off or adjust the light level as required. These devices are shown as controlling external dimmer 300. However, they could control dimmer control circuit 20 directly.

The output of external dimmer 300 or external inputs 301, 302, 303, 304 and 305 when controlling dimmer control circuit 20 directly can be connected to dimmer control circuit 20 by wiring (either high or low voltage), by power line carrier, by radio frequency signals, by use of a telephone interface or through any other suitable means.

FIGS. 13*a* to 13*h* illustrate in schematic fashion some of the possible arrangements depicted in FIG. 13.

Figure 13A:
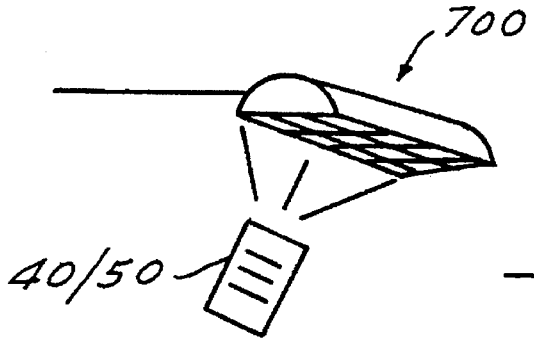
FIGS. 13*a* to 13*h* schematically illustrate some subcombinations which can be used with the invention.

Thus, FIG. 13*a* illustrates a remote infrared transmitter 40/50 which can dim stand-alone single fixture 700 which is equipped with a dimming ballast and radiation receiver (not shown). Fixture 700 could be replaced by any other controllable electrical appliance. Of course, a plurality of spaced fixtures could be dimmed from a common transmitter, or they could be selectively dimmed.

Figure 13B:
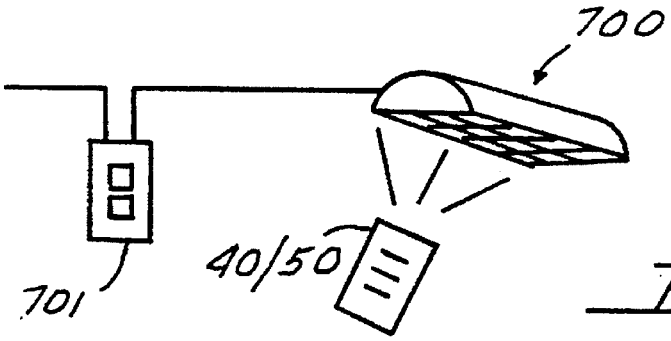

FIG. 13*b* shows the system of FIG. 13*a* in which a wall mounted dimmer 701 is added, and wherein the last-operated dimmer 701 or transmitter 40/50 controls the output of fixture 700. Alternatively, the upper trim limit and lower trim limit for fixture 700 may be controlled from the wall dimmer 701.

Figure 13C:
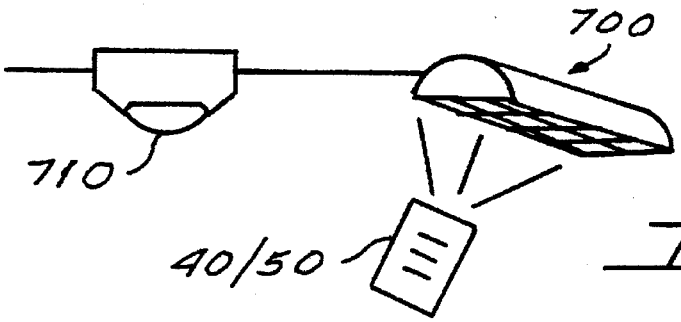

FIG. 13*c* shows the system of FIG. 13*a* with an occupancy sensor 710 which can control the on/off or high/low dim condition for fixture 700.

Figure 13D:
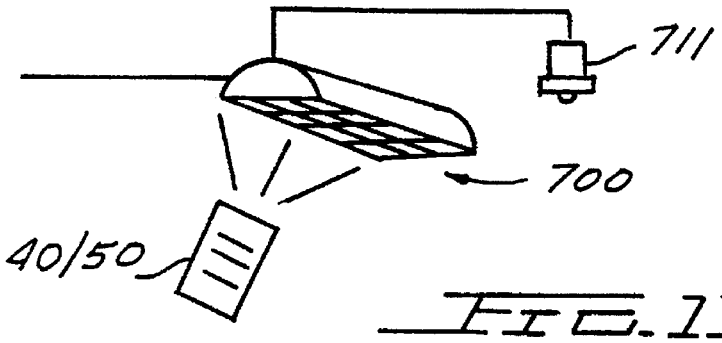

As shown in FIG. 13*d*, a photosensor 711 can be coupled to the dimmer control of fixture 700 to control the output of fixture 700 independently of control 40/50, and in response to ambient light conditions.

Figure 13E:
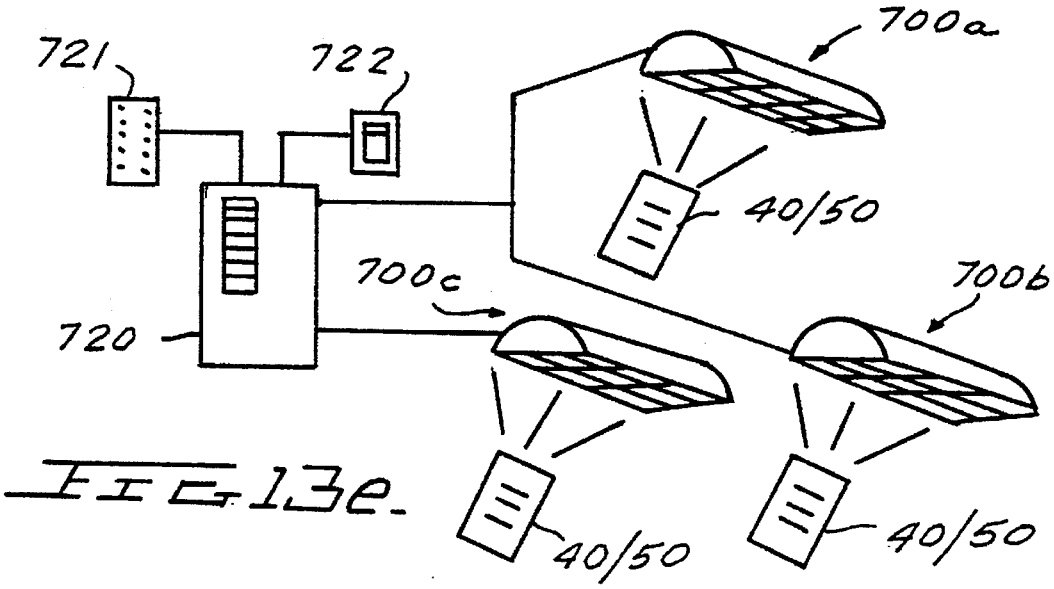

FIG. 13*e* shows the manner in which a relay panel 720 and its controls 721 (a remote) and 722 (a wall mounted control) can control spaced fixtures 700*a*, 700*b* and 700*c*. The fixtures can be selectively grouped (fixtures 700*a* and 700*b*) to be selectively operable independently of fixture 700*c* from the relay panel, yet each fixture can be selectively operable under the control of the radiation transmitter 40/50.

Figure 13F:
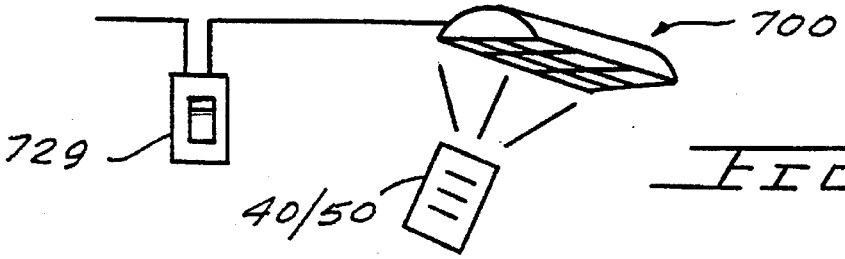
Figure 13G:
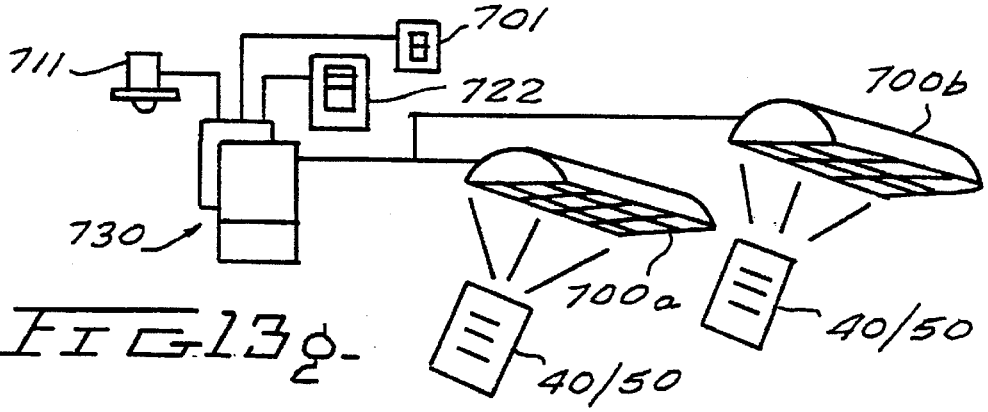

FIG. 13*f* shows the system of FIG. 13*a* with the superimposed control of a time clock 729. The system of FIG. 13*a* can also have the overriding control of a microWATT™ controller made and sold by Lutron Electronics Co., Inc., as shown in FIG. 13*g*. Thus, two fixtures 700*a* and 700*b*, which are operable by one or more identical transmitters 40/50, have a superimposed control of control elements 711 (a photosensor), 701 (a wall mounted dimmer), 722 (a time-clock control) through 730 (the microWATT unit).

Figure 13H:
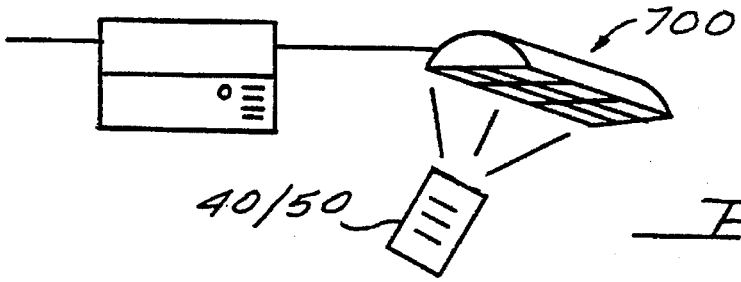

FIG. 13*h* shows the fixture 700 and transmitter 40/50 with the overriding control of a Grafik Eye (preset) made and sold by Lutron Electronics Co., Inc.

FIG. 14 shows a typical layout of fluorescent fixtures in a ceiling. Thus, four fixtures 150, 151, 152 and 153, each two feet by four feet in dimension, are mounted on side-to-side centers of eight feet and end-to-end centers of fourteen feet. Each fixture is equipped with the system of the invention (as shown, for example, in FIGS. 1 to 9) and each has a wide angle lens protrusion 82. By using an infrared transmitter with an 8° output beam, each of the spaced fixtures can be easily discriminated from one another to adjustably dim each fixture independently of all others. By way of example, assume an office has a size of thirty feet by thirty feet, and a ceiling height of ten feet. It can be shown that the transmitter, held at a height of three feet and pointed straight up toward the ceiling, will illuminate a circle 160 about one foot in diameter. Thus, fixtures spaced as closely as two feet apart can be easily discriminated. Further, a person standing five feet from a wall of the room and holding the transmitter at a height of three feet can illuminate a comet-shaped area 161 at the other end of the room having a length of about nine feet and a width of about 3.6 feet. Thus, it is possible to easily discriminate any of fixtures 150 to 154 from any location in the room.

Figure 15A:
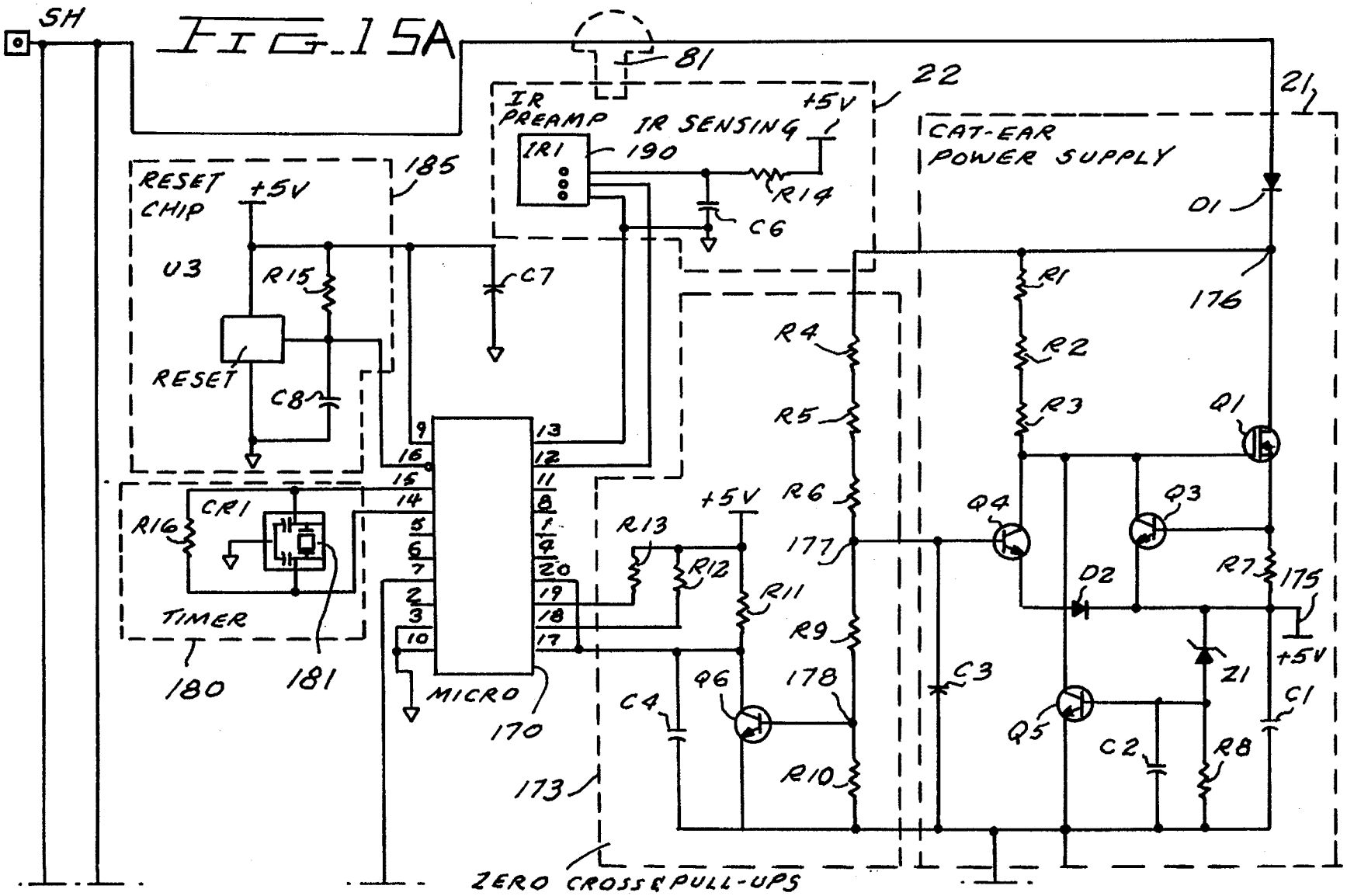
FIG. 15 is a circuit diagram of the receiver circuit/ballast control circuit, EEPROM, and power supply of FIG. 1.
Figure 15B:
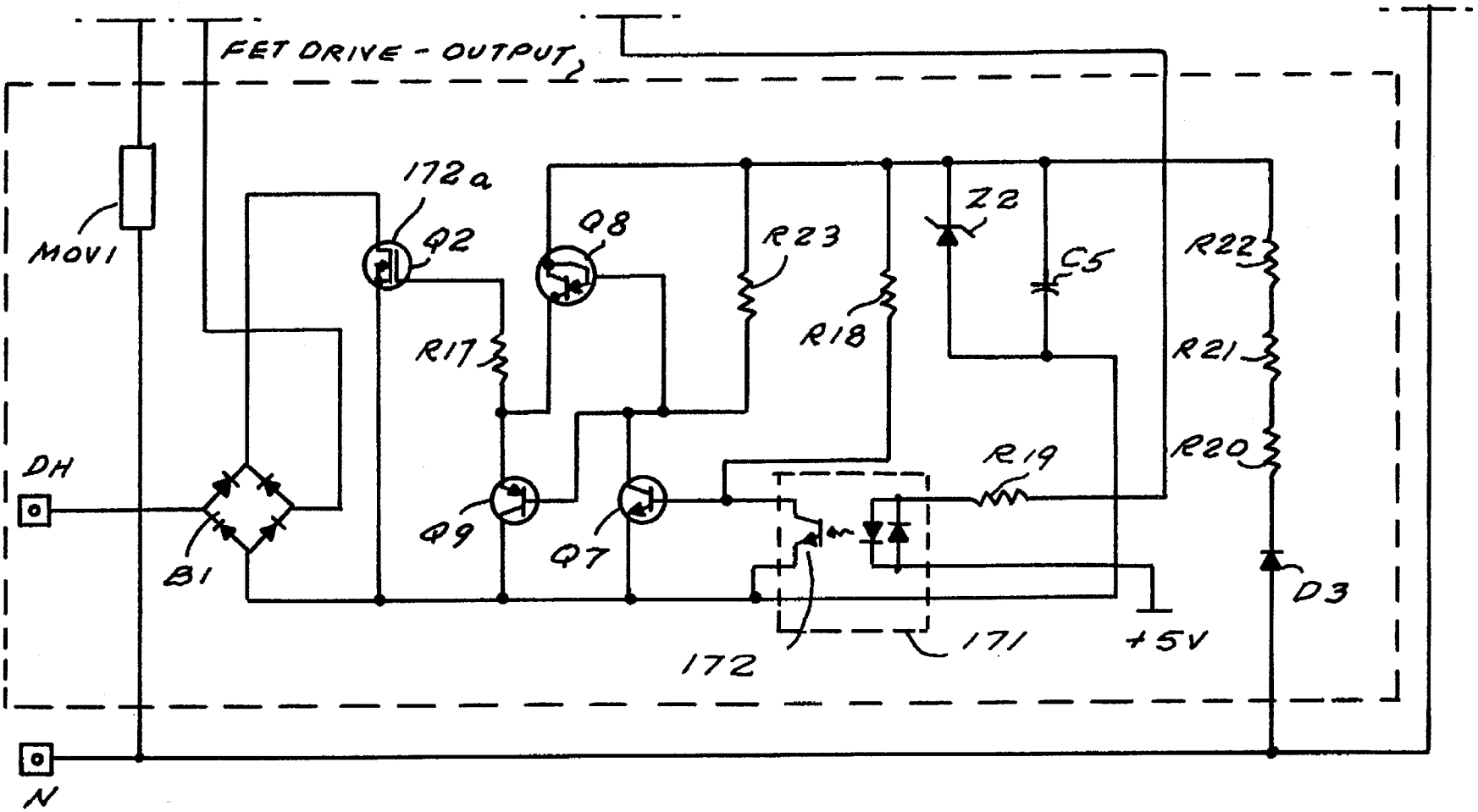

FIG. 15 is a circuit diagram of the receiver of FIG. 1. In FIG. 15, both the microprocessor 24 and EEPROM 23 of FIG. 1 are each contained in the integrated circuit 170 which is a type ST6260.

FIG. 15 shows the switch hot SH, dim hot DH, and neutral N leads together with an optocoupled power switch 171, which is shown as a type TLP620 optocoupler containing a transistor 172 optically coupled to LEDs which are, in turn, controlled by the output of a zero cross-detection circuit 173 to be later described. A suitable amplifier couples the output of transistor 172 to the control power MOSFET 172a which is, in turn, connected to terminal "DH". Power switch circuit 171 corresponds to the dimmer 25 in FIG. 1, and is carried by circuit board 63.

The power supply circuit is also contained within the circuit of FIG. 15, and is shown within block 21. Power supply 21 produces a regulated 5 volt output at terminal 175 which is connected to the various 5 volt terminals in the circuit. The main power supply control device is MOSFET $Q_1$. The control circuit is well known. Generally, in operation, if the voltage at output terminal 175 increases, transistor $Q_5$ begins to turn on to adjust the gate drive MOSFET $Q_1$. Further, if the drain to source current through $Q_1$, is too high, the drop on resistor $R_7$ increases and begins to turn on transistor $Q_3$ to reduce the gate drive for MOSFET $Q_1$. Note that resistors $R_1$, $R_2$ and $R_3$ are pull-up resistors. Further, if the voltage at node 176 exceeds 70 volts, the voltage at node 177 of the voltage divider $R_4$, $R_5$, $R_6$, $R_9$ and $R_{10}$ turns on transistor $Q_4$ to turn off the gate of MOSFET $Q_1$.

Furthermore, when the instantaneous voltage at node 178 is less than 0.6 volts, $Q_6$ of the zero-cross sensor 173 is turned off, informing the microprocessor 170 at pins 17 and 20 that a zero-cross exists. Timing is then provided to output an appropriately phase delayed firing signal from pin 7 to the LEDs in coupler 171. Therefore, the output wave shape at 172 will be a voltage which follows the a-c wave shape for a short controlled period during each half cycle.

Next shown in FIG. 15 is a conventional timing circuit 180 which contains an 8 MHz ceramic resonator 181 connected to pins 14 and 15 of chip 170.

An undervoltage detector 185 is provided, containing a chip U3 and acting to ensure good turn off of the circuit when turn off is required. Detector 185 is connected to reset pin 16.

Finally, there is provided the infrared receiver circuit 22 which may include a Sharp GP1U56, IR preamplifier chip 190 which cooperates with lens 81, shown in dotted line outline in FIG. 15. The output of IR preamplifier 22 is connected to pin 12 and "common" of chip 170.

All other components described in FIG. 15 are interconnected as shown and the pins of chip 170 are also connected as shown.

Figure 16:
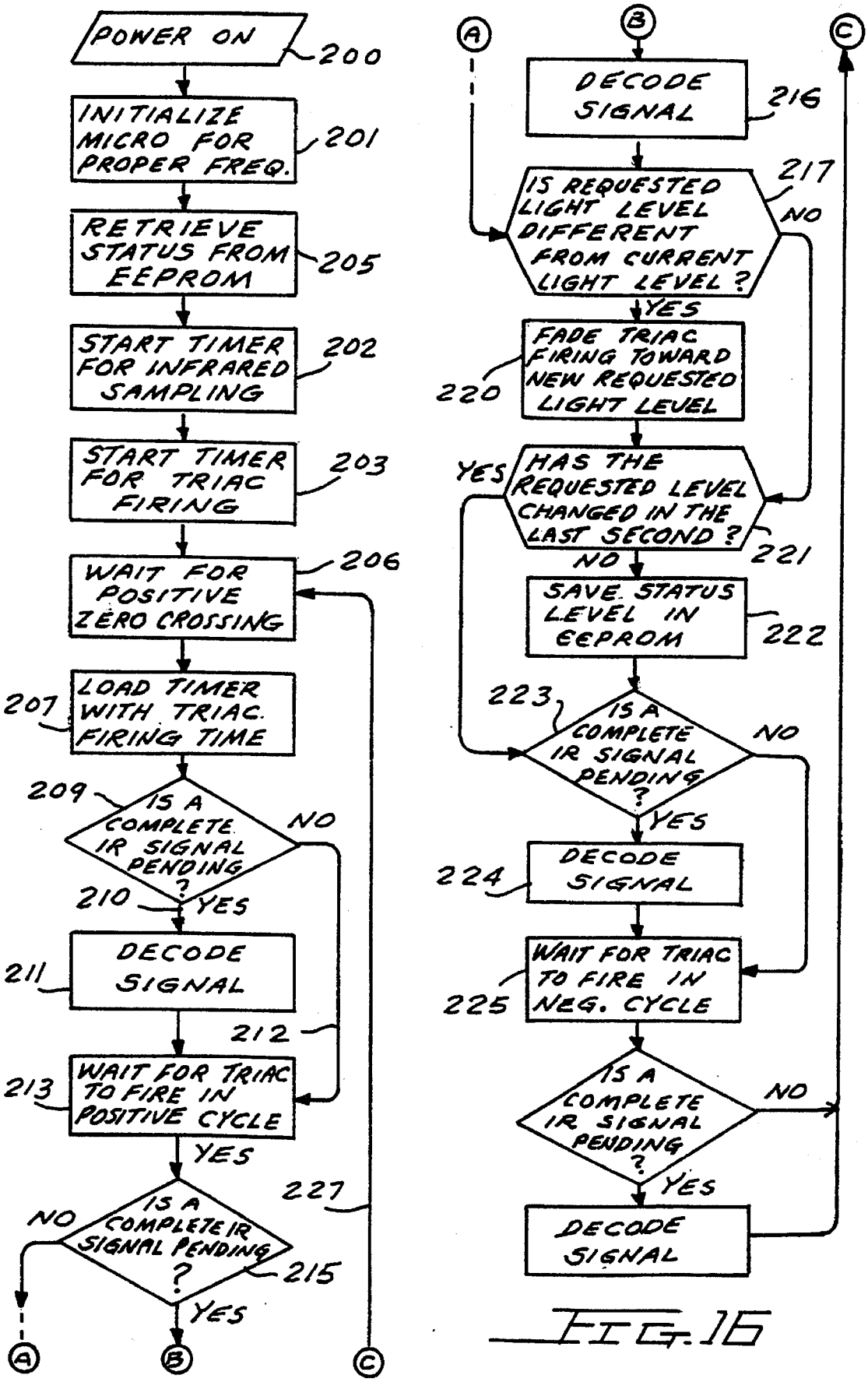
FIG. 16 is a flow diagram of the program installed in the microprocessor of FIG. 15.

The internal ROM in chip 170 is appropriately programmed. FIG. 16 shows the flow chart for an appropriate program.

Referring to FIG. 16, the program acts first (in the left-hand line) to produce a power on operation 200 and initialization operation 201. Since the installation may be for 50 Hz or 60 Hz use, a decision block may be employed to select either 50 Hz initialization or 60 Hz initialization.

After initialization, the existing status is retrieved from the EEPROM in chip 170 (step 205). The timer circuit is then started for infrared sampling (202) and the timer is started for FET drive/triac firing (203). The system then waits for a positive zero crossing (206) and, as soon as a zero-cross signal is obtained at pins 17 and 20, and at block 207, the timer of the chip 170 is loaded with the desired firing time to initiate a firing signal.

An output is then applied to decision block 209 of whether a complete infrared signal is present for decoding. Line 210 is a "yes" or signal present" and causes the decoding of the signal at block 211 in FIG. 16. If no signal is present, line 212 is followed to initiate a wait for a negative going zero-cross at 213.

After the negative zero cross, the circuit again checks whether a complete IR signal is present for decoding in block 215. If "yes", the signal is decoded in block 216 and control progresses onto block 217 where a decision is made as to whether the requested light level is different from the current light level. If "yes", the circuit causes a controlled fade at step 220 (on the right of FIG. 16) to the new decoded value which was requested by the hand held controller. A decision is then made at step 221 of whether the requested firing time has changed in the last second. If it has changed, it is recorded in the EEPROM to save the new status at block 222. The circuit then checks for a completed IR signal at step 223 and, if present, decodes it at block 224. The unit then waits for the firing of the main power device at block 225. The circuit once again checks for a complete IR signal. Thereafter, the unit waits for the next positive zero cross at 206 on line 227.

As previously described in connection with FIG. 13, additional external dimming inputs can be connected to the dimmer control circuit 20 which is mounted in the lamp fixture.

FIG. 17 shows the manner in which the use of a variable signal voltage of 0 to 10 volts (or any desired range) can be imposed on the control circuit of FIG. 15 such that the dimmer will respond to either the radiation transmitter 40 or 50 or the varied input voltage of 0 to 10 volts. The variable input voltage can be obtained, for example, from a manual dimmer, an ambient light sensor, an occupancy detector or the like.

In FIG. 17, the input signal voltage of from 0 to 10 volts is applied between input terminals 400 and 401 to the input pins 1 and 5 of a standard 555 timer integrated circuit 403. Appropriate biases are connected as shown, and output terminal 404 is connected to input port 1 of microprocessor 170 in FIG. 15. An input terminal 405 to the circuit of FIG. 17 is connected to output port 2 of microprocessor 170 of FIG. 15. Both of terminals 404 and 405 are coupled to respective pins on timer 403 through optocouplers 410 and 411.

Figure 18A:
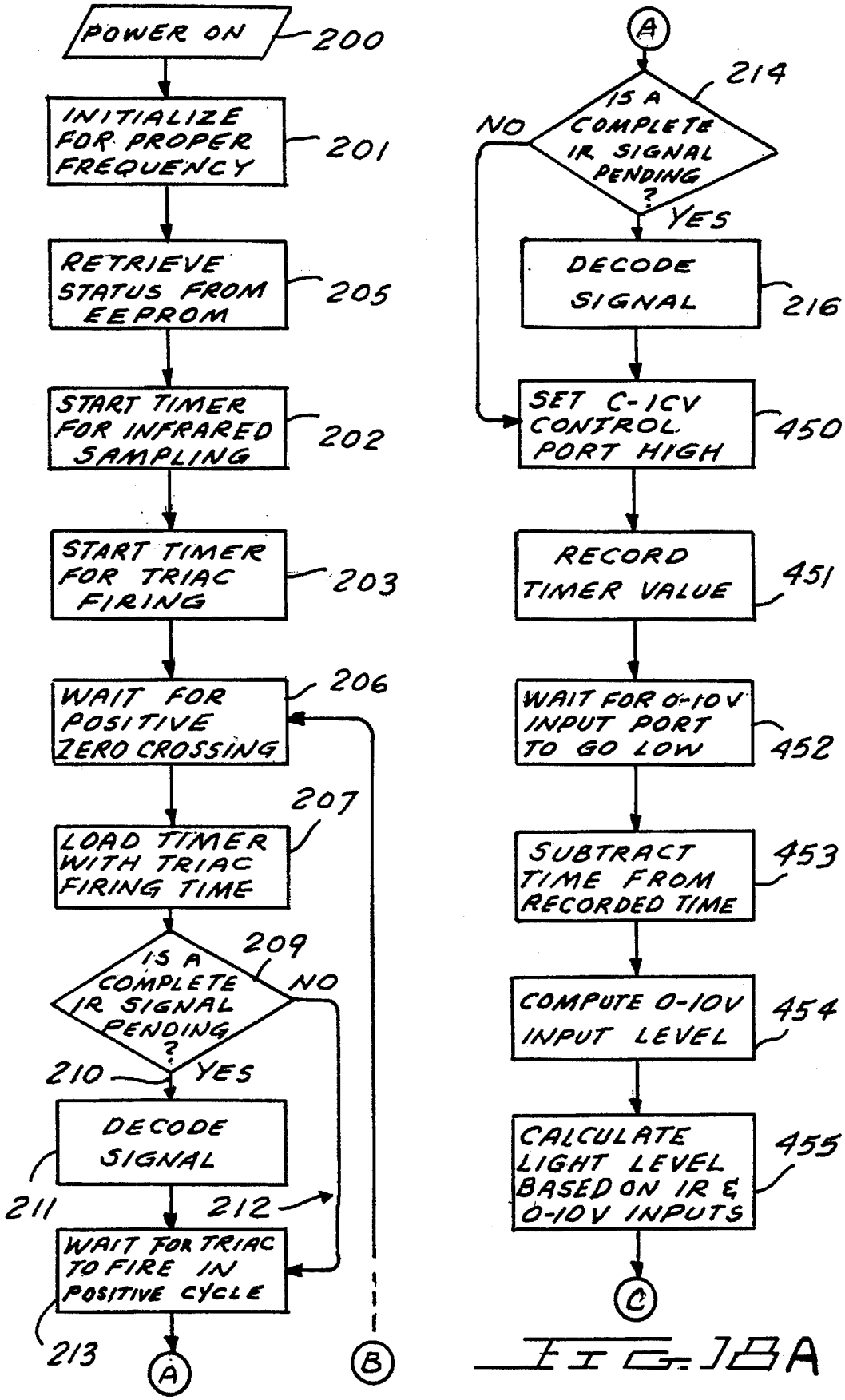
FIG. 18 is a modified flow diagram for a system of FIGS. 15 and 17.
Figure 18B:
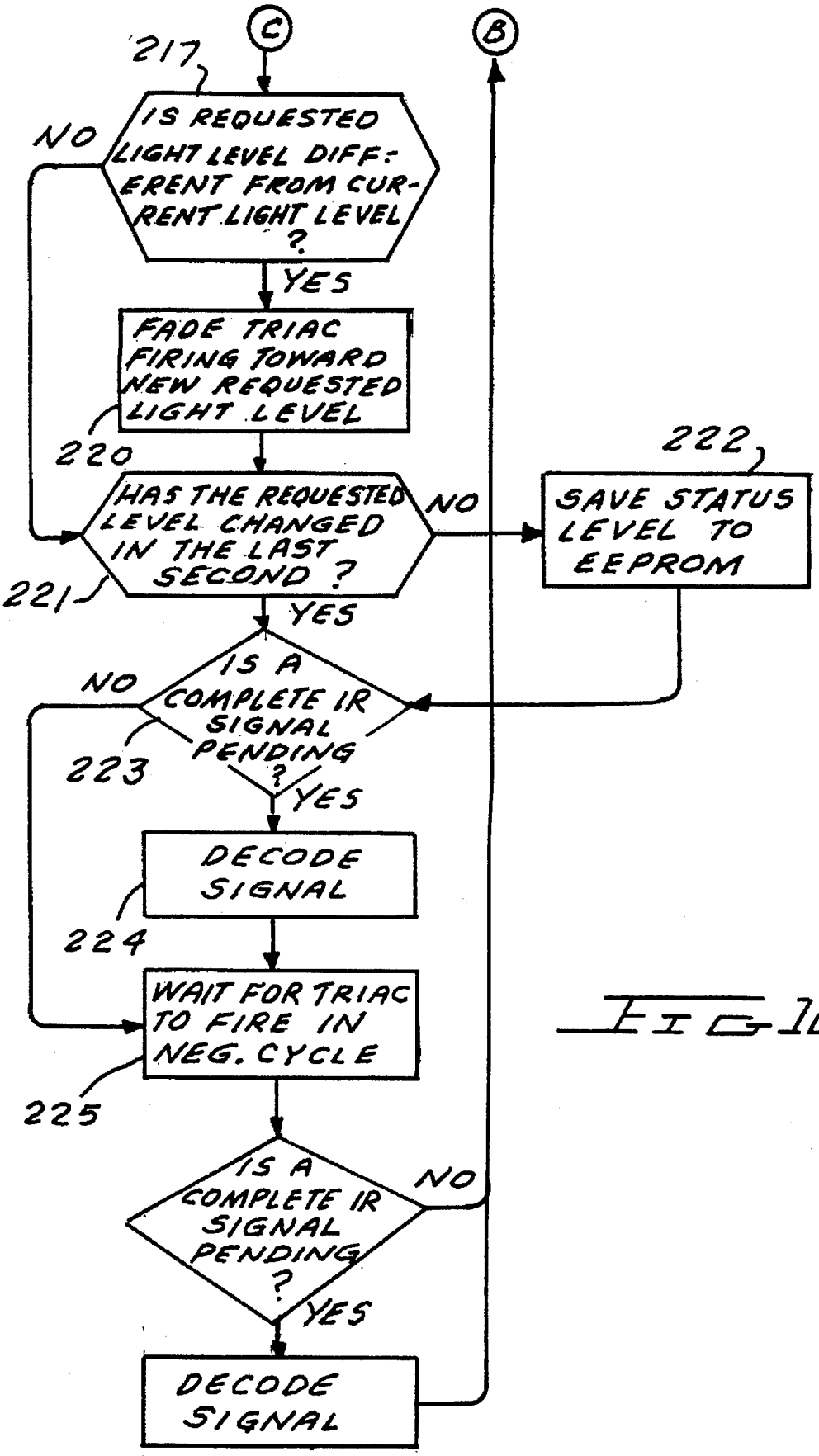

When using the input of FIG. 17, the flow chart of FIG. 16 showing the operation of microprocessor 170 is modified as shown in FIG. 18. Thus, in FIG. 18, steps 200 to 216 are the same as those of FIG. 16. Following step 216, however, the output port at terminal 405 in FIG. 17 goes high (450) and the timer value is recorded at step 451. The system then waits for the voltage at input port 404 to go low (452) and the time taken is subtracted (at 453) from the time recorded at 451. A computation is then made at step 454 of the voltage at terminal 400, and the light level corresponding to this level is calculated at step 455. It is at block 455 where the effect of the voltage signal is determined. If the voltage signal represents a high end or low end trim signal, the light level generated by the IR input is tested to see if it is lower, or higher, than the level indicated by the voltage signal level. If so, it is the level used in block 217. If not, the level set by the voltage signal is used in block 217.

If the input voltage signal is to act as an override signal, block 455 will determine which signal changed last. The level given by the last input to change will be the level used in block 217, and the system proceeds thereafter as described for FIG. 16.

FIG. 19 shows an external dimmer control circuit which can be used in place of (or along with) the external control circuit of FIG. 17. Thus, in FIG. 19, a remote control device (not shown) such as that used in the MAESTRO™ input circuit of Lutron Electronics Co., Inc. has a raise contact, a lower contact and a toggle contact. The output circuit of each of these is connected to a terminal 500 which is, in turn, coupled to output terminals 504 and 505 which are connected, in turn, to microprocessor pins 1 and 2 of microprocessor 170 of FIG. 15.

When the "raise" control is pressed, a circuit is closed on positive cycles. Thus, terminals 504 and 505 are high on positive cycles. On negative cycles, terminal 504 is high and terminal 505 is low.

When the "lower" control is pressed, there is a closure on negative cycles. Thus, terminals 504 and 505 are high and low respectively on positive cycles, and are both low on negative cycles.

The "toggle" position causes closure for several cycles. Thus, if "toggle" is pressed, terminals 504 and 505 are both high on positive cycles and low on negative cycles.

Figure 20A:
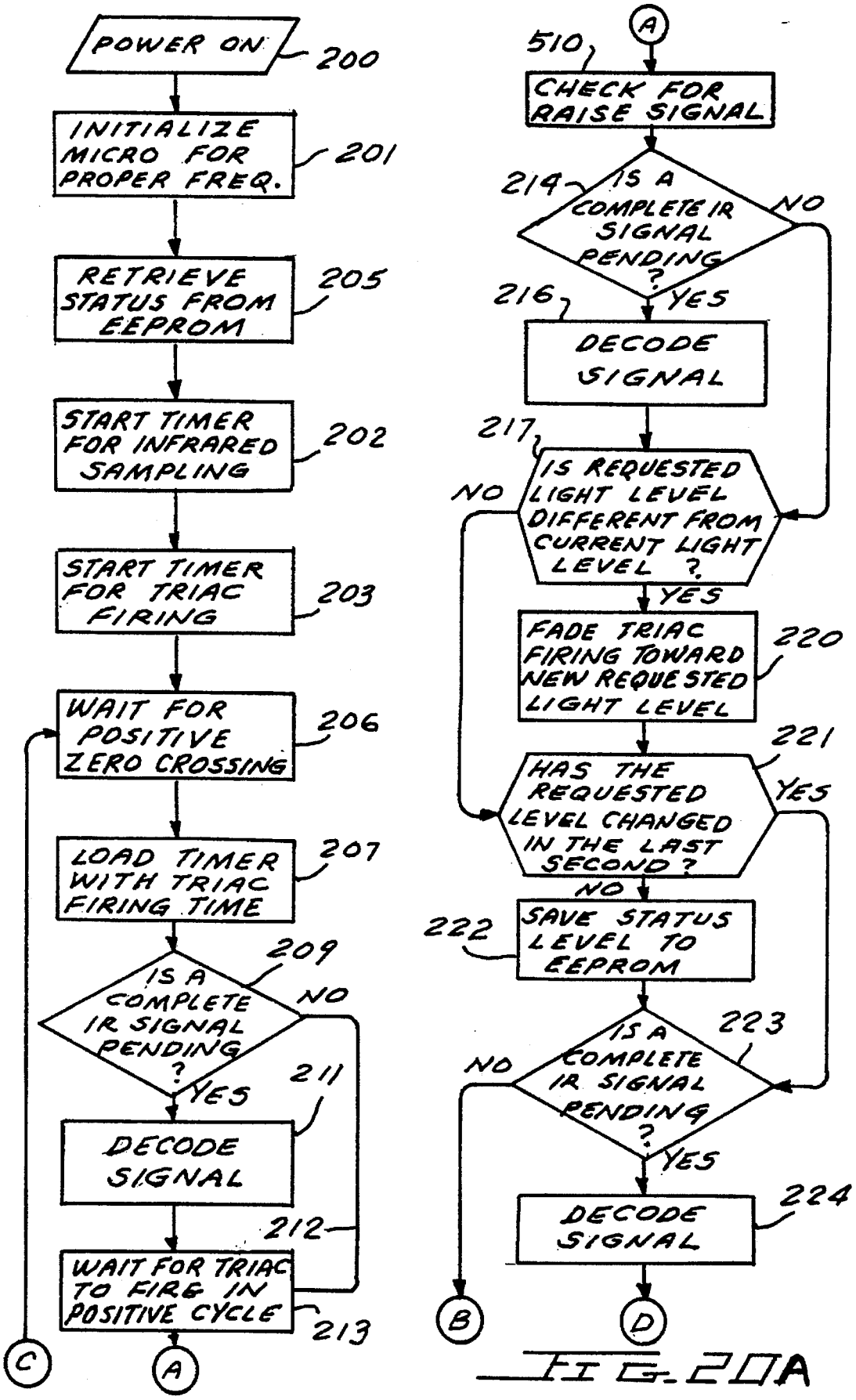
FIG. 20 is a modified flow diagram for a system of FIGS. 15 and 19.
Figure 20B:
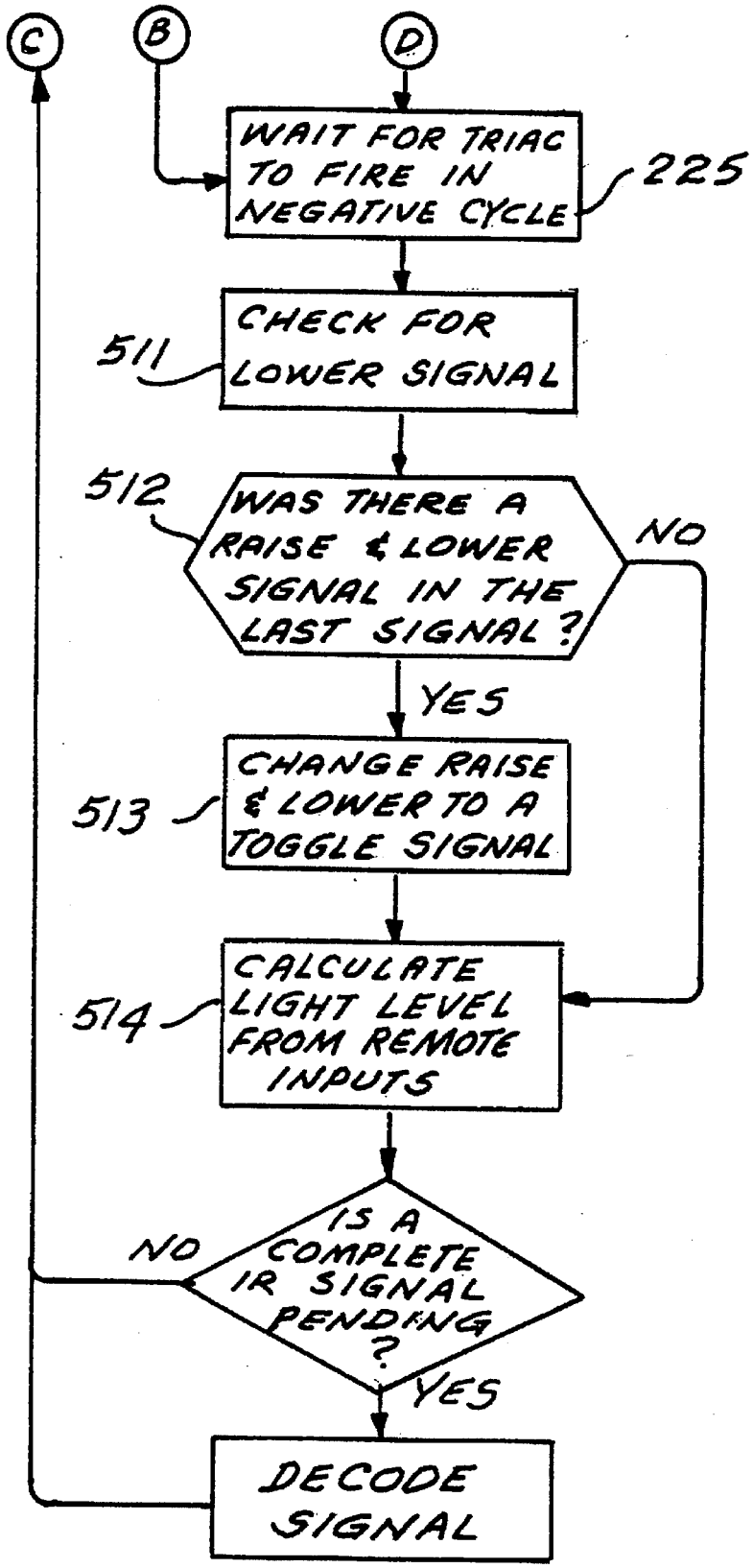

FIG. 20 shows the flow chart for the system of FIGS. 15 and 19. The chart is similar to FIG. 16 except, after step 212, the system checks for a raise signal (at step 510) and, after step 225, the system checks for a lower signal (at step 511). Then a decision is made at step 512 of whether there was a raise or lower in the last cycle. If so, the signals are changed to a toggle signal at 513 and the new light level is calculated at 514. The raise, lower, and toggle input would be interpreted in the same manner as the equivalent IR signal.

A still further kind or remote input which is useful with the invention is a phase control input, as shown in FIG. 21, which is used in the Hi-Lume® dimmer of Lutron Electronics Co., Inc. Thus, in FIG. 21, a phase controlled input signal is connected to terminals 600 and 601. This signal is coupled by optocoupler 602 to terminal 603, which is connected to input port 1 of microprocessor 170 in FIG. 15. The control circuit of FIG. 21 can be located in a wall mounted dimmer and a 1 nanofarad capacitor 604 provides noise immunity. The three resistors 605, 606 and 607 may be changed to accommodate 120 volt a-c to 277 volt a-c power lines.

The phase controlled wave shape on the input signal at terminals 600 and 601 provides sharply defined falling and rising edges which define the input control signal duty cycle.

Figure 22A:
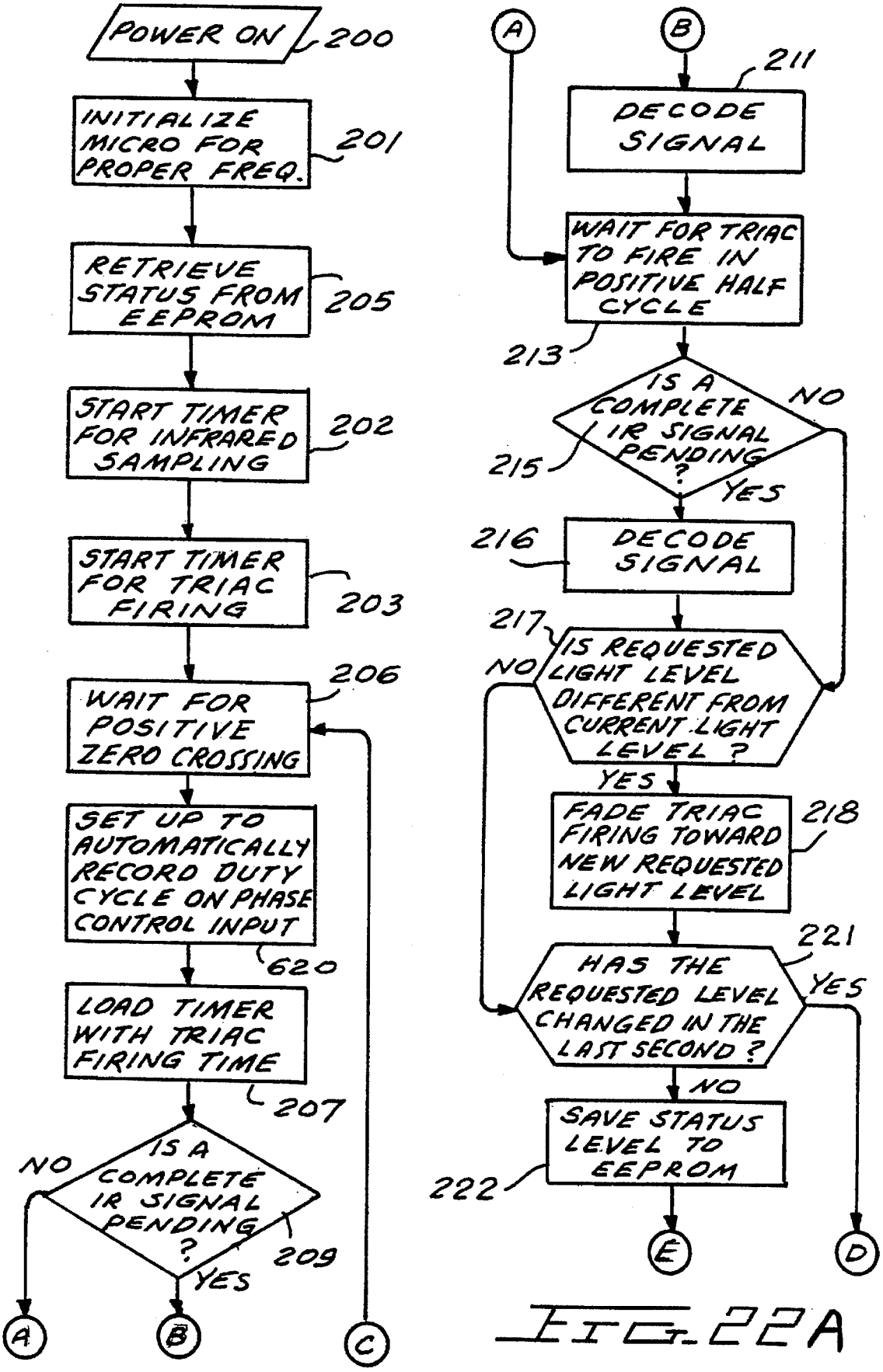
FIG. 22 is a modified flow diagram for a system of FIGS. 15 and 21.
Figure 22B:
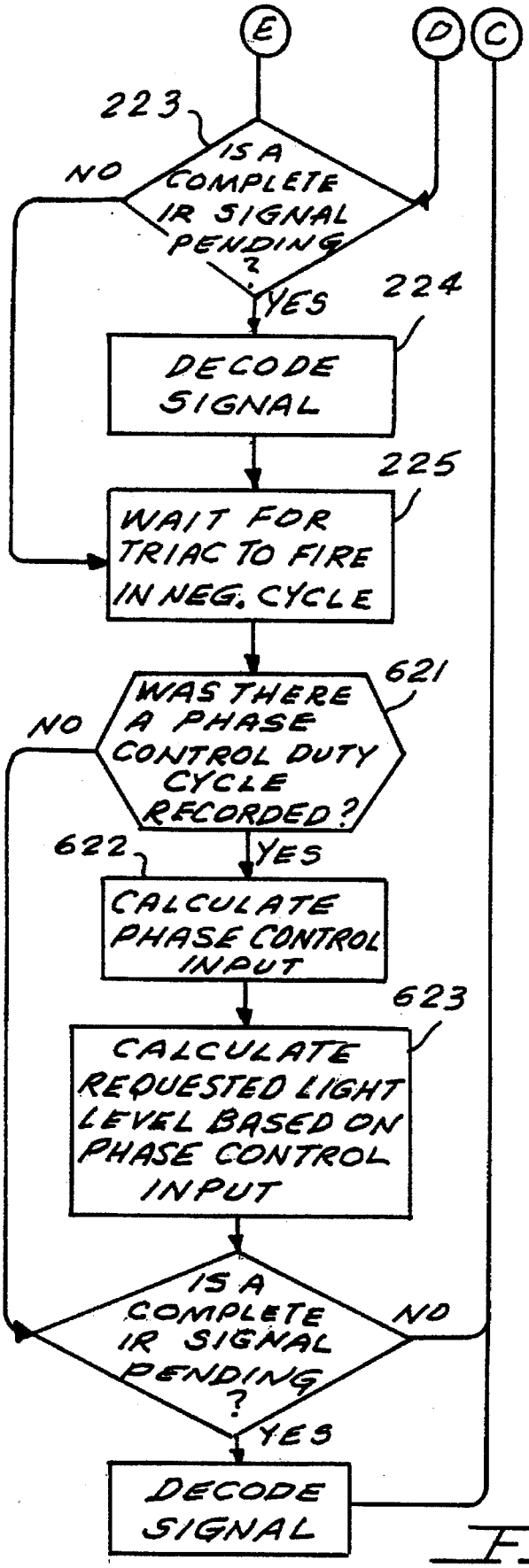

The flow diagram of FIG. 16 is shown modified in FIG. 22 for the addition of the circuit of FIG. 21. The program is different in that, after step 206 and step 620, the system is set to examine the duty cycle on the phase control input at terminals 600 and 601 in FIG. 21. Further, following step 225, a decision is made at step 621 of whether a phase control duty cycle was recorded and, if so, the phase control is calculated at step 622 and converted to a light control signal at step 623. The new light level would be calculated at block 623 similarly to how it was computed in block 455 of FIG. 18 for the voltage level signal. If it is a high end or low end trim, the IR input level is checked, and if lower or higher respectively than the phase control signal it used in block 217 on the next pass through the loop.

If it is to be used as an override signal, block 623 will decide which input was changed last, and use that value in block 217.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A light dimming system comprising in combination:

a fixture housing adapted for mounting in a ceiling;

a dimming ballast fixed within the interior of said fixture housing;

at least one lamp mounted on said fixture housing and connected to said ballast;

a radiation receiver circuit fixed within said fixture housing and having a radiation sensor;

an opening in said fixture housing in communication with said radiation sensor;

said radiation receiver being connected directly to said dimming ballast interiorly of said fixture housing, and containing a dimmer control circuit therein and being operable to adjust the output of said dimming ballast to said at least one lamp in response to the reception of a coded radiation signal by said radiation sensor;

and a portable hand-operated radiation transmitter for transmitting radiation toward said radiation sensor from a position below said fixture housing, to adjust the dimming level of said at least one lamp by adjusting the output of said radiation receiver.

2. The system of claim 1 in which said fixture housing has a wire-way cover; said opening being formed in said wire-way cover; said radiation receiver being fixed to an interior surface of said wire-way cover.

3. The system of claim 1 which further includes a radiation lens fixed to said radiation receiver and disposed in said opening and being operable to receive input coded radiation over a wide angle.

4. The system of claim 2 which further includes a radiation lens fixed to said radiation receiver and disposed in said opening and being operable to receive input coded radiation over a wide angle.

5. The system of claim 1 wherein said transmitter is operable to transmit a narrow beam of infrared radiation with selected codings for varying the dimming condition of said at least one lamp.

6. The system of claim 2 wherein said transmitter is operable to transmit a narrow beam of infrared radiation with selected codings for varying the dimming condition of said at least one lamp.

7. The system of claim 3 wherein said transmitter is operable to transmit a narrow beam of infrared radiation with selected codings for varying the dimming condition of said at least one lamp.

8. The system of claim 4 wherein said transmitter is operable to transmit a narrow beam of infrared radiation with selected codings for varying the dimming condition of said at least one lamp.

9. The system of claim 5 wherein said narrow beam is 8°.

10. The system of claim 8 wherein said narrow beam is 8°.

11. The system of claim 1 wherein said radiation receiver circuit has a wall box insulation housing with a plastic yoke cover fixed thereto and disposed across said radiation sensor; said yoke cover having an opening therein in registry with said radiation sensor; said dimmer circuit being mounted on a circuit board with said radiation sensor; said circuit board being supported across the interior of said wall box housing and generally parallel to said yoke cover.

12. The system of claim 11 in which said fixture housing has a wire-way cover; a second opening being formed in said wire-way cover; said radiation receiver circuit being fixed to an interior surface of said wire-way cover; said second opening being in communication with said opening in said yoke.

13. The system of claim 11 wherein said transmitter is operable to transmit a narrow beam of infrared radiation with selected codings for varying the dimming condition of said at least one lamp.

14. The system of claim 12 wherein said radiation receiver circuit and said interior surface of said fixture housing have cooperating Velcro strips adhered thereto for fixing said receiver circuit to said fixture housing.

15. The system of claim 14 which further includes a radiation conductor fixed in said opening in said yoke cover and being operable to receive input coded radiation over a wide angle.

16. The system of claim 15 wherein said transmitter is operable to transmit a narrow beam of infrared radiation with selected codings for varying the dimming condition of said at least one lamp.

17. A light dimming system comprising, in combination:

a fixture housing adapted for mounting in a ceiling and a dimmer control circuit mounted to said fixture housing;

at least one lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected directly to said dimmer control circuit and being operable to adjust the output of said at least one lamp in response to the reception of a coded radiation signal by said radiation sensor;

and a portable hand operated radiation transmitter for transmitting radiation toward said radiation sensor from a position below said fixture housing, to adjust the dimming of said at least one lamp by adjusting the output of said radiation receiver and of said dimmer control circuit.

18. The system of claim 17 which further includes a radiation lens fixed to said radiation receiver and disposed in said opening and being operable to receive input coded radiation over a wide angle.

19. The system of claim 17 wherein said transmitter is operable to transmit a narrow beam of infrared radiation with selected codings for varying the dimming condition of said at least one lamp.

20. The system of claim 19 wherein said narrow beam is 8°.

21. The system of claim 17 wherein said radiation receiver has a wall box insulation housing with a plastic yoke cover disposed across said radiation sensor; said dimmer control circuit being mounted on a circuit board with said radiation sensor; said yoke cover having an opening therein in registry with said radiation sensor; said circuit board being supported on said yoke cover and generally parallel to said yoke cover.

22. The system of claim 21 wherein said radiation receiver circuit and said interior surface of said fixture have cooperating Velcro strips adhered thereto for fixing said receiver circuit to said fixture housing.

23. The system of claim 1 which further includes a plurality of said fixture housings, dimming ballasts, lamps, and radiation receivers; each of said fixtures being spaced from one another on a ceiling by at least two feet in all directions.

24. The system of claim 2 which further includes a plurality of said fixture housings, dimming ballasts, lamps, and radiation receivers; each of said fixtures being spaced from one another on a ceiling by at least two feet in all directions.

25. The system of claim 3 which further includes a plurality of said fixture housings dimming ballasts lamps, and radiation receivers; each of said fixtures being spaced from one another on a ceiling by at least two feet in all directions.

26. The system of claim 5 which further includes a plurality of said fixture housings, dimming ballasts, lamps, and radiation receivers; each of said fixtures being spaced from one another on a ceiling by at least two feet in all directions; said transmitter beam being small enough to discriminate between said openings in each of said sensors.

27. The system of claim 26 wherein said narrow beam is 8°.

28. A light dimming system comprising, in combination:

a fixture housing adapted for mounting in a ceiling and a dimmer control circuit mounted to said fixture housing;

at least one lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected to said dimmer control circuit and being operable to adjust the output of said at least one lamp in response to the reception of a coded radiation signal by said radiation sensor;

a portable hand operated radiation transmitter for transmitting radiation toward said radiation sensor from a position below said fixture housing, to adjust the dimming of said at least one lamp by adjusting the output of said radiation receiver and of said dimmer control circuit;

and an external switch means mounted remotely of said fixture housing and connected to said dimmer control circuit and operable to modify the output of said dimmer control circuit; said external switch means being operable to override the operation of said radiation transmitter.

29. The light dimming system of claim 28, wherein said external switch means is a manual on-off switch.

30. The light dimming system of claim 28, wherein said external switch means is a timeclock.

31. The light dimming system of claim 28, wherein said external switch means is an occupancy sensor.

32. The light dimming system of claim 28, wherein said external switch means includes at least a portion of a central relay system.

33. The light dimming system of claim 28, wherein said external switch means is at least one device selected from the group consisting of an on-off switch, an occupancy sensor, a time clock and a central relay system.

34. The system of claim 28 in which said fixture housing has a wire-way cover; said opening being formed in said wire-way cover; said radiation receiver being fixed to an interior surface of said wire-way cover.

35. The system of claim 34 which further includes a radiation lens fixed to said radiation receiver and disposed in said opening and being operable to receive input coded radiation over a wide angle.

36. The system of claim 28 wherein said transmitter is operable to transmit a narrow beam of infrared radiation with selected codings for varying the dimming condition of said at least one lamp.

37. The system of claim 28 wherein said radiation receiver circuit has a wall box insulation housing with a plastic yoke cover fixed thereto and disposed across said radiation sensor; said yoke cover having an opening therein in registry with said radiation sensor; said dimmer circuit being mounted on a circuit board with said radiation sensor; said circuit board being supported on said yoke cover and generally parallel to said yoke cover.

38. A light dimming system comprising, in combination:

a fixture housing adapted for mounting in a ceiling and a dimmer control circuit mounted to said fixture housing;

at least one lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected to said dimmer control circuit and being operable to adjust the output of said at least one lamp in response to the reception of a coded radiation signal by said radiation sensor;

a portable hand operated radiation transmitter for transmitting radiation toward said radiation sensor from a position below said fixture housing, to adjust the dimming of said at least one lamp by adjusting the output of said radiation receiver and of said dimmer control circuit; and an external dimmer means mounted remotely of said fixture housing and connected to said dimmer control circuit and operable to adjust the dimming of said at least one lamp.

39. The light dimming system of claim 38, wherein said external dimmer means is operable to set minimum light level of said at least one lamp.

40. The light dimming system of claim 38, wherein said external dimmer is operable to set the maximum light level of said at least one lamp.

41. The light dimming system of claim 38, wherein said dimmer control circuit is operable to adjust the dimming of said at least one lamp independently of said radiation transmitter.

42. The light dimming system of claim 38, wherein the output signal of said external dimmer means to said dimmer control circuit is a phase controlled signal.

43. The light dimming system of claim 38 wherein the output signal of said external dimmer means to said dimmer control circuit is a variable voltage signal.

44. The light dimming system of claim 38 wherein the output signal of said external dimmer means to said dimmer control circuit is a raise/lower signal.

45. The light dimming system of claim 38 which further includes external switch means mounted remotely of said fixture housing and connected to said dimmer control circuit and operable to modify the output of said dimmer control circuit; said external switch means being operable to override the operation of said radiation transmitter.

46. The light dimming system of claim 45, wherein said external switch is an on-off switch.

47. The light dimming system of claim 45, wherein said external switch is an occupancy sensor.

48. The light dimming system of claim 45, wherein said external switch is a central relay station.

49. The light dimming system of claim 38, wherein said external dimmer means has a manual input.

50. The light dimming system of claim 38, wherein said external dimmer means has a photosensor input.

51. The light dimming system of claim 38, wherein said external dimmer means has an occupancy sensor input.

52. The light dimming system of claim 38, wherein said external dimmer means has a time-clock input.

53. The light dimming system of claim 38 wherein the last operated of said dimmer control circuit or said radiation transmitter determines the dimming level of said at least one lamp.

54. A light dimming system comprising in combination:

a fixture housing adapted for mounting in a ceiling;

a dimming ballast fixed within the interior of said fixture housing;

at least one lamp mounted on said fixture housing and connected to said ballast;

a radiation receiver circuit fixed within said fixture housing and having a radiation sensor;

an opening in said fixture housing in communication with said radiation sensor;

said radiation receiver being connected directly to said dimming ballast interiorly of said fixture housing, and containing a dimmer control circuit therein and being operable to adjust the output of said dimming ballast to said at least one lamp in response to the reception of a coded radiation signal by said radiation sensor;

a portable hand-operated radiation transmitter for transmitting radiation toward said radiation sensor from a position below said fixture housing, to adjust the dimming level of said at least one lamp by adjusting the output of said radiation receiver;

said fixture housing having a wire-way cover; said opening being formed in said wire-way cover; said radiation receiver being fixed to an interior surface of said wire-way cover; said opening being located to minimize the direct reception of radiation by said radiation sensor from said lamp.

55. The system of claim 54, wherein said transmitter is operable to transmit a narrow beam of infrared radiation with selected codings for varying the dimming condition of said at least one lamp.

56. The system of claim 55, wherein said narrow beam is 8°.

57. The system of claim 54, wherein said radiation receiver circuit has a wall box insulation housing with a plastic yoke cover fixed thereto and disposed across said radiation sensor; said yoke cover having an opening therein in registry with said radiation sensor; said dimmer circuit being mounted on a circuit board with said radiation sensor; said circuit board being supported on said yoke cover and generally parallel to said yoke cover.

58. The system of claim 57 in which a lens is affixed in said opening in said yoke cover.

59. A lighting system comprising at least first and second lighting fixtures mounted in the ceiling of a room having a height of approximately 8 feet; each of said lighting fixtures having respective dimmer circuits and radiation sensors whereby the output light of each of said first and second lighting fixtures can be adjusted by illuminating said radiation sensors with infrared radiation; said first and second lighting fixtures being spaced by greater than two feet; and a portable radiation transmitter having an output infrared beam with a beam angle of about 8°; each of said radiation sensors having an angle of reception which is greater than about 30°, whereby the radiation sensor of either of said first or second lighting fixtures can be illuminated by the beam of said radiation transmitter without illuminating the other.

60. The lighting system of claim 59, wherein said radiation sensors each include removable and replaceable wide angle reception lenses which have an angle of reception which is between 30° and 60°.

61. The lighting system of claim 59 wherein said radiation sensors are adaptable to be mounted into any type of lighting fixture.

62. A control system for selectively controlling only one of a plurality of controllable devices and comprising, in combination:

respective housings for mounting and containing respective ones of said plurality of controllable devices in spaced apart relationship;

a respective radiation receiver circuit fixed within each of said housings and having respective radiation sensors;

an opening in each of said housings which is in communication with each of said respective radiation sensors;

each of said radiation receiver circuits being connected directly to its respective controllable device and being operable to adjust the operation of said controllable device in response to the reception of a coded radiation signal by said radiation sensor;

and a portable hand-operated radiation transmitter for transmitting radiation toward a selective one of said radiation sensors to adjust the operation of said one of said controllable devices independently of the others of said controllable devices.

63. The system of claim 62, wherein said housings are lighting fixtures mounted on the ceiling of a room in spaced relationship and wherein said controllable devices are dimmer controls for controlling the output light of their said respective lighting fixture.

64. The system of claim 62 which further includes a respective radiation lens fixed to each of said radiation receivers and disposed in said respective openings and being operable to receive input radiation over a wide angle.

65. The system of claim 63 which further includes a respective radiation lens fixed to each of said radiation receivers and disposed in said respective openings and being operable to receive input radiation over a wide angle.

66. The system of claim 65, wherein said transmitter is operable to transmit a narrow beam of infrared radiation with selectable codings for varying the dimming condition of any one of said lighting fixtures relative to any other of said fixtures.

67. The system of claim 66, wherein said narrow beam is 8°.

68. The system of claim 62, wherein said radiation receiver has a wall box insulation housing with a plastic yoke cover disposed across said radiation sensor; said dimmer control circuit being mounted on a circuit board with said radiation sensor; said yoke cover having an opening therein in registry with said radiation sensor; said circuit board being supported across the interior of said wall box housing and generally parallel to said yoke cover.

69. The system of claim 68, wherein each of said radiation receiver circuits and the interior of each of said housings have cooperating Velcro strips adhered thereto for fixing said receiver circuits to their said respective housings.

70. The system of claim 62 in which said controllable devices are motors.

71. The system of claim 62 in which said controllable devices are solenoids.

72. A light dimming system comprising, in combination:

a fixture housing adapted for mounting in a ceiling and a dimmer control circuit mounted to said fixture housing;

at least one lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected directly to said dimmer control circuit and being operable to adjust the output of said at least one lamp in response to the reception of a coded radiation signal by said radiation sensor;

and a portable hand operated radiation transmitter for transmitting encoded radiation toward said radiation sensor from a position below said fixture housing, to adjust the dimming of said at least one lamp by adjusting the output of said radiation receiver and of said dimmer control circuit;

said radiation transmitter transmitting alternately encoded radiation to adjust the low end trim of said dimmer control circuit.

* * * * *

US005637964C1

(12) EX PARTE REEXAMINATION CERTIFICATE (6004th)

United States Patent
Hakkarainen et al.

(10) Number: US 5,637,964 C1
(45) Certificate Issued: Nov. 13, 2007

(54) REMOTE CONTROL SYSTEM FOR INDIVIDUAL CONTROL OF SPACED LIGHTING FIXTURES

(75) Inventors: Simo P. Hakkarainen, Bethlehem, PA (US); Russell L. MacAdam, Allentown, PA (US); Scott C. Miller, Lehighton, PA (US); Ian Rowbottom, Chalfont, PA (US); Joel S. Spira, Coopersburg, PA (US)

(73) Assignee: Lutron Electronics Co., Inc., Coopersburg, PA (US)

Reexamination Request:
No. 90/007,039, May 14, 2004

Reexamination Certificate for:

| | |
|---|---|
| Patent No.: | **5,637,964** |
| Issued: | **Jun. 10, 1997** |
| Appl. No.: | **08/407,696** |
| Filed: | **Mar. 21, 1995** |

(51) Int. Cl.
*G05F 1/00* (2006.01)

(52) U.S. Cl. ..... 315/295; 315/321; 315/149; 315/158; 315/DIG. 4

(58) Field of Classification Search ..... None
See application file for complete search history.

(56) References Cited

U.S. PATENT DOCUMENTS 5,099,193 A * 3/1992 Moseley et al. ..... 323/324
5,554,979 A 9/1996 Kohar et al. ..... 340/825.72
5,592,033 A * 1/1997 Gold ..... 315/159
5,623,256 A * 4/1997 Marcoux ..... 315/312

FOREIGN PATENT DOCUMENTS

| | | | |
|---|---|---|---|
| DE | 27 00 503 | * | 7/1978 |
| EP | 0 031 874 | * | 9/2004 |
| JP | 05-111075 | | 4/1993 |
| JP | 05-242719 | | 9/1993 |
| JP | 06-303670 | | 10/1994 |

OTHER PUBLICATIONS

English translation of Abstract for Japanese Patent Application No. 05–242719.
English translation of Abstract for Japanese Patent Application No. 05–111075.
English translation of Abstract for Japanese Patent Application No. 06–303670.

* cited by examiner

*Primary Examiner*—Minh Nguyen

(57) ABSTRACT

A plurality of spaced ceiling mounted fixtures or other controllable electrical appliances have wide angle radiation detectors mounted within each fixture and wired internally of the fixture to a dimming circuit or to a ballast. The radiation detectors have sensitivity over a wide angle and are fixed over a small opening in the fixture. A narrow beam radiation transmitter selectively illuminates one of the radiation detectors without illuminating the others. The dimming circuits or ballasts within the fixtures can be further controlled by external dimmers, occupancy sensors, timeclocks, photosensors and other types of input devices.

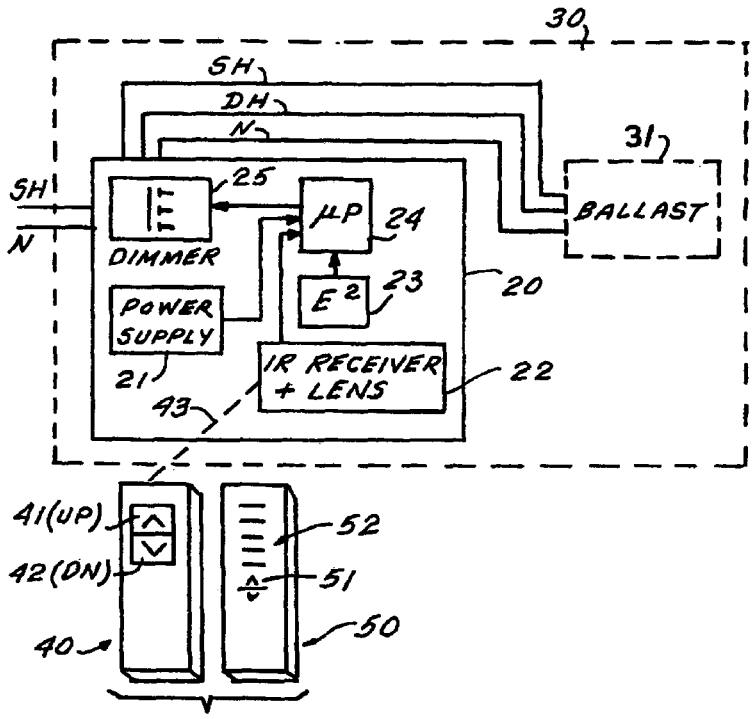

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 59–61 is confirmed.

Claims 70–71 are cancelled.

Claims 1, 5–8, 13, 17, 19, 23–26, 28, 36, 38–41, 53–55, 62–63 and 72 are determined to be patentable as amended.

Claims 2–4, 9–12, 14–16, 18, 20–22, 27, 29–35, 37, 42–52, 56–58 and 64–69, dependent on an amended claim, are determined to be patentable.

1. A light dimming system comprising in combination:

a fixture housing adapted for mounting in a ceiling;

a dimming ballast fixed within the interior of said fixture housing;

at least one *gas discharge* lamp mounted on said fixture housing and connected to said ballast;

a radiation receiver circuit fixed within said fixture housing and having a radiation sensor;

an opening in said fixture housing in communication with said radiation sensor;

said radiation receiver being connected directly to said dimming ballast interiorly of said fixture housing, and containing a dimmer control circuit therein and being operable to adjust the output of said dimming ballast to said at least one *gas discharge* lamp in response to the reception of a coded radiation signal by said radiation sensor; *and*

[and] a portable hand-operated radiation transmitter for transmitting radiation toward said radiation sensor from a position below said fixture housing, to adjust the dimming level of said at least one lamp by adjusting the output of said radiation receiver.

5. The system of claim 1 wherein said transmitter is operable to transmit a narrow beam of infrared radiation with selected codings for varying the dimming condition of said at least one *gas discharge* lamp.

6. The system of claim 2 wherein said transmitter is operable to transmit a narrow beam of infrared radiation with selected codings for varying the dimming condition of said at least one *gas discharge* lamp.

7. The system of claim 3 wherein said transmitter is operable to transmit a narrow beam of infrared radiation with selected codings for varying the dimming condition of said at least one *gas discharge* lamp.

8. The system of claim 4 wherein said transmitter is operable to transmit a narrow beam of infrared radiation with selected codings for varying the dimming condition of said at least one *gas discharge* one lamp.

13. The system of claim 11 wherein said transmitter is operable to transmit a narrow beam of infrared radiation with selected codings for varying the dimming condition of said at least one *gas discharge* lamp.

17. A light dimming system comprising, in combination:

a fixture housing adapted for mounting in a ceiling and a dimmer control circuit mounted to said fixture housing;

at least one *gas discharge* lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected directly to said dimmer control circuit and being operable to adjust the output of said at least one *gas discharge* lamp in respponse to the reception of a coded radiation signal by said radiation sensor; *and*

[and] a portable hand operated radiation transmitter for transmitting radiation toward said radiation sensor from a position below said fixture housing, to adjust the dimming of said at least one *gas discharge* lamp by adjusting the output of said radiation receiver and of said dimmer control circuit.

19. The system of claim 17 wherein said transmitter is operable to transmit a narrow beam of infrared radiation with selected codings for varying the dimming condition of said at least one *gas discharge* lamp.

23. The system of claim 1 which further includes a plurality of said fixture housings, dimming ballasts, *gas discharge* lamps, and radiation receivers; each of said fixtures being spaced from one another on a ceiling by at least two feet in all directions.

24. The system of claim 2 which further includes a plurality of said fixture housings, dimming ballasts, *gas discharge* lamps, and radiation receivers; each of said fixtures being spaced from one another on a ceiling by at least two feet in all directions.

25. The system of claim 3 which further includes a plurality of said fixture housings, dimming ballasts *gas discharge* lamps, and radiation receivers; each of said fixtures being spaced from one another on a ceiling by at least two feet in all directions.

26. The system of claim 5 which further includes a plurality of said fixture housings, dimming ballasts, *gas discharge* lamps, and radiation receivers; each of said fixtures being spaced from one another on a ceiling by at least two feet in all directions; said transmitter beam being small enough to discriminate between said openings in each of said sensors.

28. A light dimming system comprising, in combination:

a fixture housing adapted for mounting in a ceiling and a dimmer control circuit mounted to said fixture housing;

at least one *gas discharge* lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected to said dimmer control circuit and being operable to adjust the output of said at least one *gas discharge* lamp in response to the reception of a coded radiation signal by said radiation sensor;

a portable hand operated radiation transmitter for transmitting radiation toward said radiation sensor from a position below said fixture housing, to adjust the dimming of said at least one *gas discharge* lamp by adjusting the output of said radiation receiver and of said dimmer control circuit;

and an external switch means mounted remotely of said fixture housing and connected to said dimmer control circuit and operable to modify the output of said dimmer control circuit; said external switch means being operable to override the operation of said radiation transmitter.

36. The system of claim 28 wherein said transmitter is operable to transmit a narrow beam of infrared radiation with selected codings for varying the dimming condition of said at least one *gas discharge* lamp.

38. A light dimming system comprising, in combination:

a fixture housing adapted for mounting in a ceiling and a dimmer control circuit mounted to said fixture housing;

at least one *gas discharge* lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected to said dimmer control circuit and being operable to adjust the output of said at least one *gas discharge* lamp in response to the reception of a coded radiation signal by said radiation sensor;

a portable hand operated radiation transmitter for transmitting radiation toward said radiation sensor from a position below said fixture housing, to adjust the dimming of said at least one *gas discharge* lamp by adjusting the output of said radiation receiver and of said dimmer control circuit; and an external dimmer means mounted remotely of said fixture housing and connected to said dimmer control circuit and operable to adjust the dimming of said at least one *gas discharge* lamp.

39. The light dimming system of claim 38, wherein said external dimmer means is operable to set minimum light level of said at least one *gas discharge* lamp.

40. The light dimming system of claim 38, wherein said external dimmer is operable to set maximum light level of said at least one *gas discharge* lamp.

41. The light dimming system of claim 38, wherein said dimmer control circuit is operable to adjust the dimming of said at least one *gas discharge* lamp independently of said radiation transmitter.

53. The light dimming system of claim 38 wherein the last operated of said dimmer control circuit or said radiation transmitter determines the dimming level of said at least one *gas discharge* lamp.

54. A light dimming system comprising in combination:

a fixture housing adapted for mounting in a ceiling;

a dimming ballast fixed within the interior of said fixture housing;

at least one *gas discharge* lamp mounted on said fixture housing and connected to said ballast;

a radiation receiver circuit fixed within said fixture housing and having a radiation sensor;

an opening in said fixture housing in communication with said radiation sensor;

said radiation receiver being connected directly to said dimming ballast interiorly of said fixture housing, and containing a dimmer control circuit therein and being operable to adjust the output of said dimming ballast to said at least one *gas discharge* lamp in respponse to the reception of a coded radiation signal by said radiation sensor;

a portable hand-operated radiation transmitter for transmitting radiation toward said radiation sensor from a position below said fixture housing, to adjust the dimming level of said at least one *gas discharge* lamp by adjusting the output of said radiation receiver;

said fixture housing having a wire-way cover; said opening being formed in said wire-way cover; said radiation receiver being fixed to an interior surface of said wire-way cover; said opening being located to minimize the direct reception of radiation by said radiation sensor from said *gas discharge* lamp.

55. The system of claim 54, wherein said transmitter is operable to transmit a narrow beam of infrared radiation with selected codings for varying the dimming condition of said at least one *gas discharge* lamp.

62. A control system for selectively controlling only one of a plurality of controllable *ballast* devices [and] comprising, in combination:

*a plurality of gas discharge lamps respectively connected with said controllable ballast devices;* respective housings for mounting *in a ceiling* and containing respective ones of said plurality of controllable *ballast* devices in spaced apart relationship;

a respective radiation receiver circuit fixed within each of said housings and having respective radiation sensors;

an opening in each of said housings which is in communication with each of said respective radiation sensors;

each of said radiation receiver circuits being connected directly to its respective controllable *ballast* device and being operable to adjust the operation of said controllable device in response to the reception of a coded radiation signal by said radiation sensor; *and*

[and] a portable hand-operated radiation transmitter for transmitting radiation toward a selective one of said radiation sensors to adjust the operation of said one of said controllable devices independently of the others of said controllable devices.

63. The system of claim 62, wherein said housings are lighting fixtures mounted on the ceiling of a room in spaced relationship and wherein said controllable *ballast* devices are dimmer controls for controlling the output light of their said respective lighting fixture.

72. A light dimming system comprising, in combination:

a fixture housing adapted for mounting in a ceiling and a dimmer control circuit mounted to said fixture housing;

at least one *gas discharge* lamp mounted on said fixture housing and connected to said dimmer control circuit;

a radiation receiver circuit fixed within said fixture housing and having a radiation sensor;

an opening in said fixture housing in communication with said radiation sensor;

said radiation receiver circuit being connected directly to said dimmer control circuit and being operable to adjust the output of said at least one *gas discharge* lamp in response to the reception of a coded radiation signal by said radiation sensor;

[and] a portable hand operated radiation transmitter for transmitting encoded radiation toward said radiation sensor from a position below said fixture housing, to adjust the dimming of said at least one *gas discharge* lamp by adjusting the output of said radiation receiver and of said dimmer control circuit;

said radiation transmitter transmitting alternately encoded radiation to adjust the low end trim of said dimmer control circuit.

* * * * *